US007106999B2

(12) United States Patent
Takahashi

(10) Patent No.: US 7,106,999 B2
(45) Date of Patent: Sep. 12, 2006

(54) FIXING DEVICE

(75) Inventor: Keisuke Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 17 days.

(21) Appl. No.: 10/878,014

(22) Filed: Jun. 29, 2004

(65) Prior Publication Data

US 2004/0265018 A1 Dec. 30, 2004

(30) Foreign Application Priority Data

Jun. 30, 2003 (JP) ..... 2003-188839

(51) Int. Cl.
*G03G 15/20* (2006.01)

(52) U.S. Cl. ..... 399/328; 399/122; 399/330; 399/331; 399/335; 219/216

(58) Field of Classification Search ..... 399/328
See application file for complete search history.

(56) References Cited

U.S. PATENT DOCUMENTS 5,822,669 A * 10/1998 Okabayashi et al. ..... 399/330
6,037,576 A * 3/2000 Okabayashi et al. ..... 219/619
6,154,629 A * 11/2000 Kinouchi et al. ..... 399/329
6,445,902 B1 * 9/2002 Hirst et al. ..... 399/328
6,591,082 B1 * 7/2003 Samei et al. ..... 399/329
2004/0105708 A1 * 6/2004 Imai et al. ..... 399/330

FOREIGN PATENT DOCUMENTS

JP A 11-297462 10/1999

* cited by examiner

*Primary Examiner*—David M. Gray
*Assistant Examiner*—Ryan D. Walsh
(74) *Attorney, Agent, or Firm*—Oliff & Berridge, PLC

(57) ABSTRACT

A fixing device in an image forming device that includes a rotating heating roller, a coil provided on the outside of the heating roller, a heating mechanism using the coil to heat the heating roller through electromagnetic induction, and a pressure roller that contacts the heating roller with pressure and, together with the heating roller, pinches and conveys a recording paper in order to fix developer that has been transferred onto the recording paper, wherein a magnetic layer is formed over the pressure roller to increase the amount of magnetic flux passing through the surface of the heating roller.

24 Claims, 14 Drawing Sheets

FIXING DEVICE

BACKGROUND OF THE INVENTION

1. Field of the Invention

The present invention relates to a fixing device for fixing developer that has been transferred onto a recording medium. The present invention also relates to an image forming device employing the fixing device.

2. Description of Related Art

An image forming device such as a laser printer is conventionally provided with a fixing device for fixing developer that has been transferred onto a recording medium. A typical fixing device includes a cylindrical heating roller and a pressure roller disposed parallel to and in contact with the heating roller. Developer such as toner that has been transferred onto a recording medium such as paper is fixed onto the recording medium, as the medium passes between the heating roller and the pressure roller, by the heat of the heating roller, which is heated to about 150° C. (degrees Celsius).

Conventional fixing devices employ a halogen lamp or an electromagnetic induction type heating device as a source for heating the heating roller. In the former type of fixing device, a halogen lamp is disposed inside a hollow heating roller. When an electric current flows through the halogen lamp, infrared rays emitted from the halogen lamp strike the inside walls of the heating roller, generating heat that is transferred to the surface of the roller. This construction requires fasteners or fixing mechanisms for fixing the halogen lamp in the heating roller, a component for connecting the halogen lamp to an electric circuit, and the like. Since parts that do not contact the paper, including the fasteners and the connecting component, are all heated uniformly, a large amount of heat is dissipated in the air, wasting much energy. Moreover, a longer warm-up time is required for the heating roller to reach the required temperature for fixing the developer (around 150° C.) after a current is applied to the halogen lamp.

In contrast, fixing devices that employ an electromagnetic induction type heating device to heat the heating roller can decrease the amount of wasted energy and can reduce the warm-up time.

For example, Japanese patent application publication No. HEI-11-297462 discloses a fixing device employing an electromagnetic-induction heating device. The fixing device includes a heating roller with an iron cylinder core and a pressure roller and disposes the electromagnetic-induction heating device on the side of the heating roller opposite the area contacting the recording medium. The electromagnetic-induction type heating device is configured such that a coil is supported along the outer surface of the heating roller by a support. When an alternating current is supplied to the coil, a magnetic-field is generated around the coil and magnetic flux passing through the surface of the heating roller generates an eddy current. Joule heat is generated on the surface of the heating roller by the eddy current and the resistivity on the surface of the heating roller, thereby heating the heating roller.

SUMMARY OF THE INVENTION

However, the fixing device disclosed in Japanese patent application publication No. HEI-11-297462 is problematic in that some magnetic flux may leak outside of the heating roller without passing through the surface thereof. As a result, the amount of flux passing through the surface of the heating roller is reduced by the amount of leaked flux, thereby reducing heating efficiency.

In view of the above-described drawbacks, it is an objective of the present invention to provide a fixing device that employs a coil disposed outside a heating member to heat the heating member through electromagnetic induction, wherein the fixing device achieves excellent heating efficiency by reducing the amount of magnetic flux leaking outside the heating member without passing through the surface thereof and increasing the amount of magnetic flux passing through the surface of the heating member.

In order to attain the above and other objects, the present invention provides a fixing device for fixing a developer onto a recording medium. The fixing device includes a heating member, a magnetic-flux generating unit, and a pressing member. The heating member has a surface and is rotatable about an axis. The axis extends in an axial direction. The magnetic-flux generating unit includes a coil disposed outside the heating member, and a current supplying unit supplying the coil with a current, thereby generating magnetic flux for heating the heating member through electromagnetic induction effect. The pressing member is in pressure contact with the heating member and pinches and conveys the recording medium in cooperation with the heating member in order to fix the developer on the recording medium. The pressing member includes a first magnetic member that increases an amount of the magnetic flux that passes through the surface of the heating member.

The present invention also provides an image forming device including a transferring device and a fixing device. The transferring device transfers a developer onto a recording medium and forms a non-fixed image thereon. The fixing device fixes the non-fixed image on the recording medium with heat. The fixing device includes a heating member, a magnetic-flux generating unit, and a pressing member. The heating member has a surface and is rotatable about an axis. The magnetic-flux generating unit includes a coil disposed outside the heating member, and a current supplying unit supplying the coil with a current, thereby generating magnetic flux for heating the heating member through electromagnetic induction effect. The pressing member is in pressure contact with the heating member and pinches and conveys the recording medium in cooperation with the heating member in order to fix the developer on the recording medium. The pressing member includes a first magnetic member that increases an amount of the magnetic flux that passes through the surface of the heating member.

BRIEF DESCRIPTION OF THE DRAWINGS

In the drawings:

FIG. 2(*b*) is a cross-sectional view as viewed from an arrow IIB—IIB of FIG. 1;

FIG. 8(*b*) is an explanatory diagram (perspective view) conceptually showing a second magnetic member according to the fourth embodiment;

FIG. 15(*b*) is an explanatory diagram showing another modification in which a magnetic permeability ratio of a second magnetic member is varied along the axial direction of the heating roller; and FIG. 15(*c*) is an explanatory diagram showing another modification in which a second magnetic member is formed dividedly to provide a plurality of magnetic member portions.

DETAILED DESCRIPTION OF THE PREFERRED EMBODIMENTS

Figure 1:
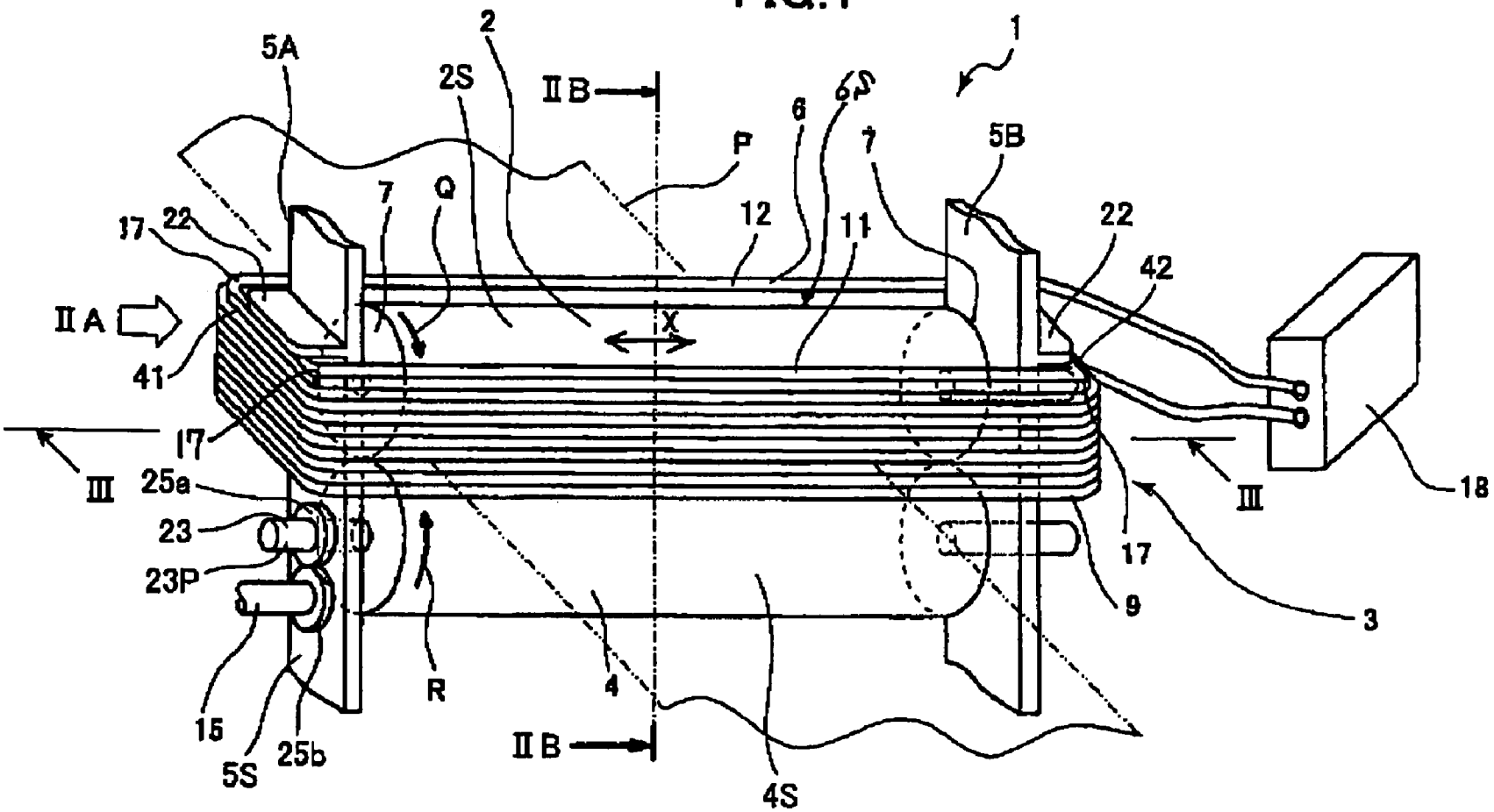
FIG. 1 is a perspective view showing the construction of a fixing device according to a first embodiment of the present invention.

A fixing device and an image forming device according to preferred embodiments of the present invention will be described while referring to the accompanying drawings wherein like parts and components are designated by the same reference numerals to avoid duplicating description.

A fixing device according to a first embodiment of the present invention will be described while referring to FIGS. 1 through 3.

Figure 2A:
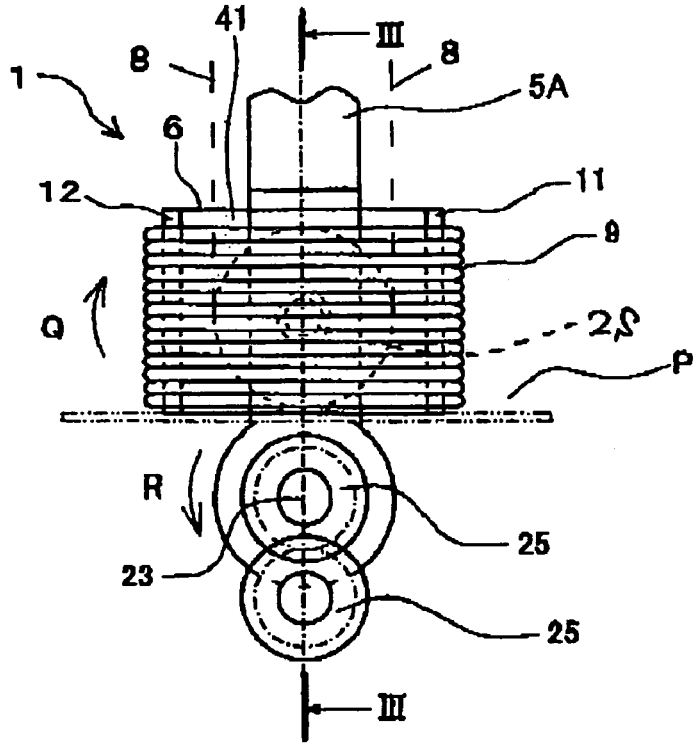
FIG. 2(*a*) is a side view as viewed from an arrow IIA of FIG. 1.
Figure 2B:
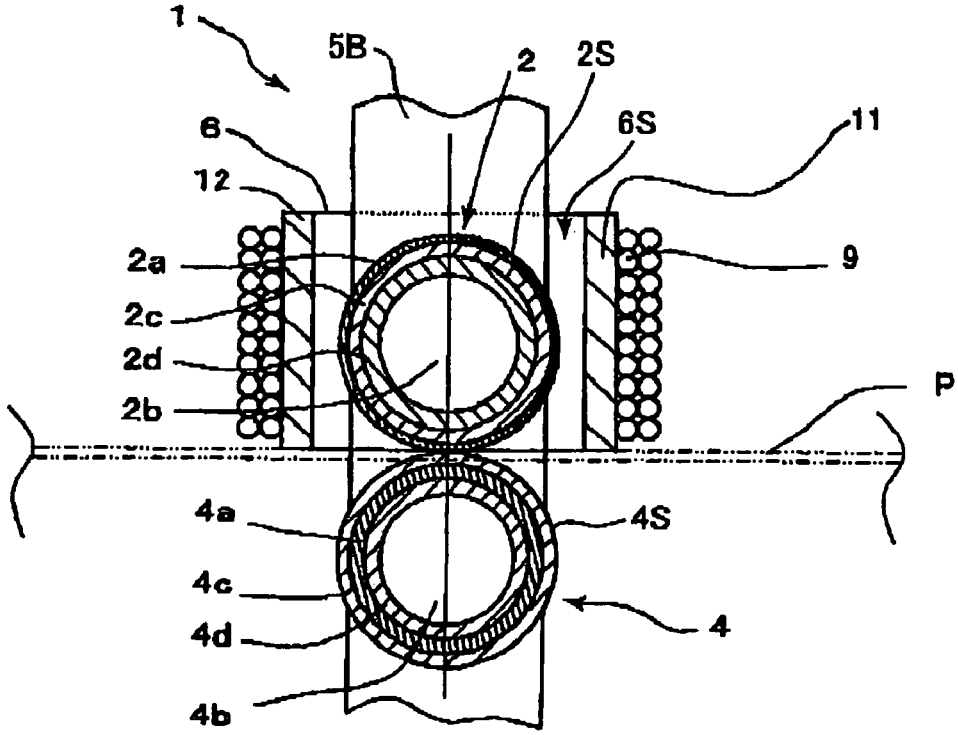
Figure 3:
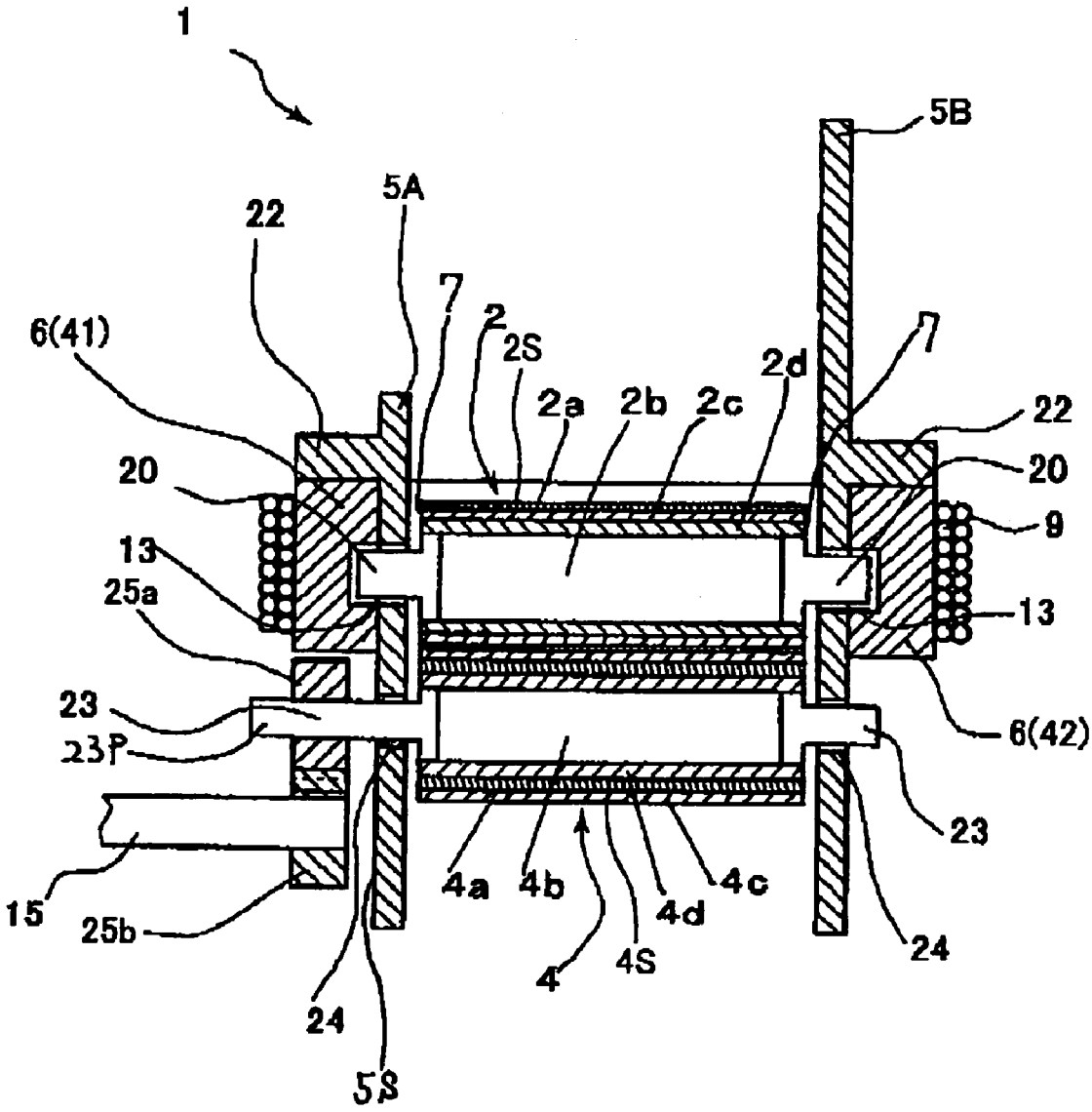
FIG. 3 is a cross-sectional view as viewed from an arrow III—III of FIGS. 1 and 2(*a*)

As shown in FIGS. 1 through 3, the fixing device 1 includes a heating roller 2 that rotates in a rotational direction Q; a heating device 3 that heats the heating roller 2 through electromagnetic induction; a pressure roller 4 for pinching and conveying a recording paper P in cooperation with the heating roller 2 in order to fix a toner image carried on the surface of the recording paper P; a driving mechanism described later for driving the heating roller 2 and the pressure roller 4, and attachment members 5A and 5B for fixing the fixing device 1 in a predetermined position of an image forming device or the like. The heating roller 2 has a peripheral surface 2S and both end surfaces 7. The pressure roller 4 has a peripheral surface 4S. Hence, the fixing device 1 melts and fixes developer such as toner on the recording paper P by pinching and conveying the recording paper P by a nip part between the heating roller 2 and the pressure roller 4. The both end surfaces 7 are positioned at both ends of the heating roller 2 in an axial direction X orthogonal to the rotational direction Q.

As shown in FIGS. 1 and 2(*a*), the heating device 3 includes a support member 6, a coil 9, and an excitation circuit 18. The support member 6 is formed in a rectangular-tube shape around the both end surfaces 7 and both imaginary side planes 8 (FIG. 2(*a*)). The both imaginary side planes 8 are defined in parallel with each other and in parallel with the axial direction X of the heating roller 2. The both imaginary side planes 8 are tangent to the peripheral surface 2S. The coil 9 is wound around the outer surface of the support member 6 to form a rectangular-tube shape that surrounds a center axis of the heating roller 2. The excitation circuit 18 supplies a current to the coil 9.

In a heating device 3 having the above-described construction, when an alternating current supplied by the excitation circuit 18 flows in the coil 9, a magnetic field is generated around the coil and magnetic flux passes through the peripheral surface 2S of the heating roller 2, generating an eddy current. The peripheral surface 2S of the heating roller 2 is heated when joule heat is generated on the surface by both the eddy current and the natural resistance of a magnetic metal layer 2*a* (FIG. 2(*b*)) forming the peripheral surface 2S.

As shown in FIGS. 2(*b*) and 3, the heating roller 2 is disposed in the empty space surrounded by the coil 9. In order to be heated by the heating device 3, the outer periphery of the heating roller 2 is covered by the magnetic metal layer 2*a*, which is formed of carbon steel, nickel, stainless steel, or the like. When a current flows through the coil 9 provided around the heating roller 2, an eddy current begins flowing along the peripheral surface 2S of the heating roller 2 to heat the same. The heating roller 2 includes a core member 2*d* formed of an insulating resin that is nonmagnetic, nonconductive, and heat-resistant, such that the peripheral surface 2S of the heating roller 2 is heated effectively. The core member 2*d* is formed with a hollow area 2*b*. An elastic layer 2*c* is provided between the core member 2*d* and the magnetic metal layer 2*a* so that the recording paper P can easily separate from the heating roller 2.

As shown in FIG. 3, a rotational shaft 20 is fitted into the hollow area 2*b* one on both axial ends of the heating roller 2 and extends outward in the axial direction. Shaft receiving portions 13 for supporting the rotational shafts 20 are formed in the support member 6. The heating roller 2 is capable of rotating since the rotational shafts 20 are supported in the shaft receiving portions 13.

With the heating roller 2 of the above-described construction, the recording paper P is pinched between the peripheral surfaces 2S of the heating roller 2 and the peripheral surface 4S of the pressure roller 4 and is conveyed by the rotations of the rollers.

As shown in FIGS. 2(*b*) and 3, the outer periphery of the pressure roller 4 is covered by an elastic layer 4*c*, enabling the recording paper P to separate easily from the pressure roller 4. The pressure roller 4 includes a core member 4*d* formed of an insulating resin that is nonmagnetic, nonconductive, and heat-resistant. The core member 4*d* is formed with a hollow area 4*b*. A magnetic layer 4*a* is provided between the core member 4*d* and the elastic layer 4*c* for increasing the amount of magnetic flux passing through the peripheral surface 2S of the heating roller 2. The magnetic layer 4*a* is formed of an insulating material such as ferrite having a high magnetic permeability ratio so as to prevent a drop in the amount of magnetic flux passing through the heating roller 2 caused by the magnetic layer 4*a* itself receiving magnetic flux and dissipating heat.

As shown in FIG. 3, the pressure roller 4 is disposed to contact the peripheral surface 2S of the heating roller 2 along the axial direction X. Rotational shafts 23 are fitted into the hollow area 4*b* in both axial ends of the pressure roller 4 and protrude outwardly in the axial direction. Shaft receiving portions 24 are formed in the attachment members 5A and 5B for rotatably supporting the rotational shafts 23. The pressure roller 4 can rotate because the rotational shafts 23 are supported in the shaft receiving portions 24. The pressure roller 4 can pinch the recording paper P against the peripheral surface 2S of the heating roller 2 and convey the recording paper P in the rotational direction.

The support member 6 is formed of an insulating resin that is nonmagnetic, nonconductive, and heat-resistant in order to increase the heating efficiency of the heating device 3.

As shown in FIGS. 1 through 2(*b*), the support member 6 includes side walls 11 and 12 and end walls 41 and 42 forming a rectangular-tube shape around the heating roller 2 including the both end surfaces 7 and the both imaginary side planes 8. The side walls 11 and 12 are disposed parallel to one another along the both imaginary side planes 8 in the axial direction X. The coil 9 is wound in a rectangular-tube shape around the side walls 11 and 12 and the end walls 41 and 42. Corner portions 17 are formed at corners where the side walls 11 and 12 and end walls 41 and 42 intersect with one another. The corner portions 17 are positioned near both end surfaces 7 of the heating roller 2. A space 6S (FIG. 2(*b*)) is formed as a space surrounded by the side walls 11 and 12 and the end walls 41 and 42.

As shown in FIG. 3, the shaft receiving portions 13 are formed in the support member 6 for supporting the rotational shafts 20 of the heating roller 2 by inserting the rotational shafts 20 therein in order to rotatably support the heating roller 2 and to maintain the relative positions of the heating roller 2 and the coil 9 with good accuracy. Further, the shaft receiving portions 24 are formed in the attachment members 5A and 5B for rotatably supporting the rotational shafts 23 of the pressure roller 4 by inserting the rotational shafts 23 therein.

As shown in FIG. 1, the corner portions 17 of the support member 6 are curved so that the coil 9 wound around the support member 6 also forms a curve from the end walls 41 and 42 to the side walls 11 and 12.

In order to suppress increases in resistance, the coil 9 includes a plurality of twisted wires, each formed of a conductive wire covered by an insulating film such as enamel.

As described above, the coil 9 is wound in a substantially rectangular-tube formation around the outer surface of the support member 6.

The attachment members 5A and 5B are formed of an insulating resin that is nonmagnetic, nonconductive, and heat-resistant in order to improve the heating efficiency of the heating device 3.

As shown in FIG. 3, the attachment members 5A and 5B are disposed inside the support member 6 near the both end surfaces 7. Each attachment member 5A and 5B includes a coupling portion 22 for linking with the support member 6, the shaft receiving portions 13 supporting the rotational shaft 20 of the heating roller 2, and the shaft receiving portions 24 supporting the rotational shafts 23 of the pressure roller 4.

An end portion (not shown) extending from each attachment member 5A and 5B is fixed to a casing (not shown) of the image forming device or the like. In other words, the fixing device 1 is mounted at a predetermined position in the device via the attachment members 5A and 5B.

The fixing device 1 includes a driving source such as a rotary motor (not shown) disposed outside the coil 9. The driving source is connected to a rotational shaft 15 for driving the pressure roller 4. A mechanism is provided for communicating the rotational force of the driving source to the pressure roller 4 and to the heating roller 2.

As shown in FIG. 1, the rotational force communicating mechanism of the fixing device 1 is configured by extending one of the rotational shafts 23 on the pressure roller 4 so that the rotational shaft 23 is supported in the shaft receiving portion 24 (FIG. 3) of the attachment members SA and 5B. A protruding portion 23P protrudes out from an outer surface 5S of the attachment member 5A. A gear 25*a* is provided on the protruding portion 23P. A gear 25*b* is provided on the rotational shaft 15 so that the protruding portion 23P is connected to the rotational shaft 15 of the drive motor via the gears 25*a* and 25*b*. With this construction, the rotational force communicated from the drive motor causes the pressure roller 4 to rotate in a direction R, while the contact between the peripheral surfaces 4S of the pressure roller 4 and the peripheral surface 2S of the heating roller 2 causes the heating roller 2 to follow the rotation of the pressure roller 4 in the direction Q.

Next, the operations and effects of the fixing device 1 according to the first embodiment described above will be described.

As described above, the fixing device 1 of the first embodiment includes the heating roller 2, the heating device 3 that employs the coil 9 disposed outside of the heating roller 2 to heat the heating roller 2 through electromagnetic induction; and the pressure roller 4 that contacts the heating roller 2 with pressure for pinching and conveying the recording paper P in cooperation with the heating roller 2 in order to fix a developer image on the recording paper P. Since the pressure roller 4 is provided with the magnetic layer 4*a* for increasing the amount of magnetic flux passing through the peripheral surface 2S of the heating roller 2, the fixing device 1 can improve the efficiency of heating the heating roller 2 through electromagnetic induction. In other words, it is possible to increase the amount of magnetic flux passing through the peripheral surface 2S of the heating roller 2 by reducing the amount of flux leaking outside the heating roller 2 without passing through the peripheral surface 2S. Therefore, the fixing device 1 is capable of heating the heating roller 2 with excellent efficiency.

Further, in the fixing device 1 of the first embodiment, the magnetic layer 4*a* is formed along the peripheral surface 4S of the pressure roller 4 for increasing the amount of magnetic flux that passes through the peripheral surface 2S of the heating roller 2. Accordingly, the fixing device 1 has excellent efficiency in heating the heating roller 2 and achieves excellent production efficiency, without adding extra components for disposing a separate magnetic member on the pressure roller 4.

Further, since the magnetic layer 4*a* according to the first embodiment is formed of an insulating material, efficiency for heating the heating roller 2 can be improved without losing heating efficiency caused by the magnetic layer 4*a* itself receiving magnetic flux and dissipating heat.

Further, the heating roller 2 is positioned within the space 6S surrounded by the coil 9 (the side walls 11 and 12 and the end walls 41 and 42) in the fixing device 1. By providing the heating roller 2 within the magnetic field in the space 6S, variations in the amount of magnetic flux passing through the surface of the heating roller 2 can be reduced, thereby improving the efficiency for heating the heating roller 2.

Next, a fixing device 31 according to a second embodiment of the present invention will be described with reference to FIGS. 4 and 5.

Figure 4:
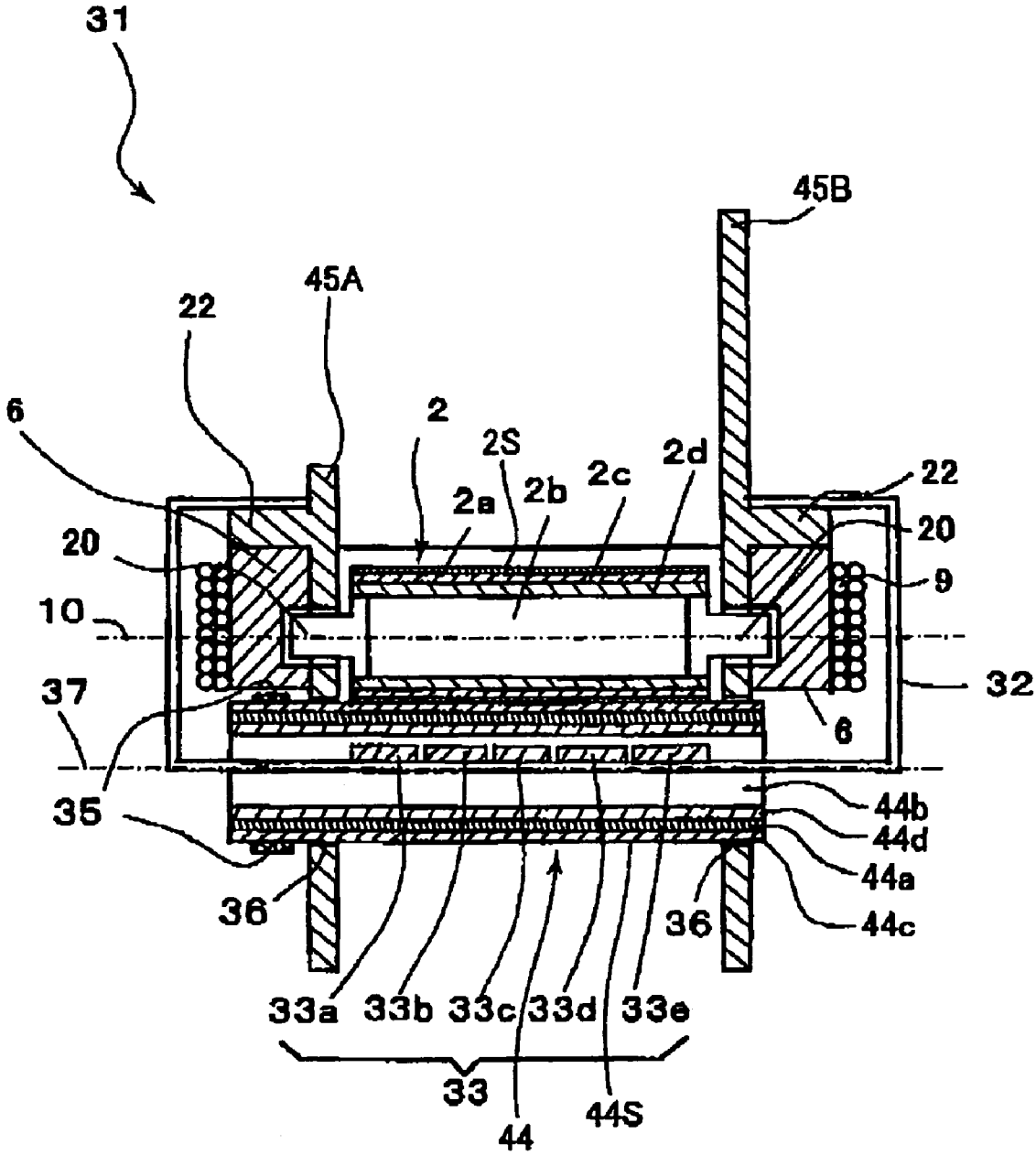
FIG. 4 is a cross-sectional view showing the construction of a fixing device according to a second embodiment of the present invention.
Figure 5:
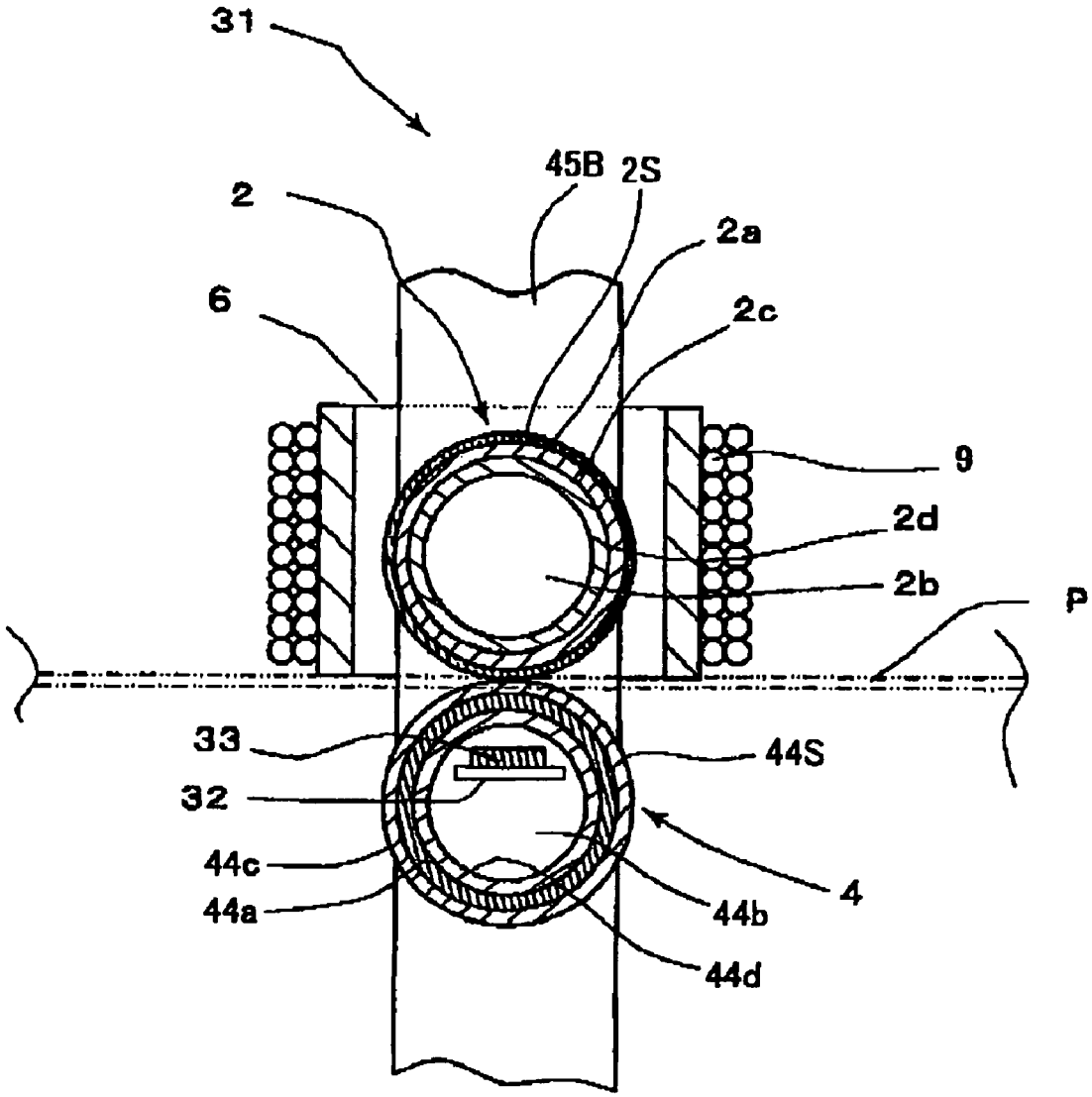
FIG. 5 is a cross-sectional view showing the construction of the fixing device according to the second embodiment.

FIGS. 4 and 5 show the construction of the fixing device 31 according to the second embodiment. FIG. 4 is a cross-sectional view corresponding to FIG. 3 of the first embodiment while FIG. 5 is a cross-sectional view corresponding to FIG. 2(*b*) according to the first embodiment.

Since the fixing device 31 of the second embodiment is similar in construction to the fixing device 1 of the first embodiment, only the features of the second embodiment will be described, and like parts and components are designated by the same reference numerals to avoid duplicating description.

As shown in FIGS. 4 and 5, the fixing device 31 is provided with a first magnetic member 33 that is supported on a supporting member 32 in the hollow area 44*b* of the pressure roller 44. Further, both ends of the supporting member 32 protrude outside of the hollow area 44*b* and are fixed to the attachment members 45A and 45B.

The first magnetic member 33 includes a plurality of magnetic members 33*a*, 33*b*, 33*c*, 33*d*, and 33*e* that are disposed at predetermined intervals along an axis 10 of the heating roller 2.

In order to improve the efficiency of heating the peripheral surface 2S of the heating roller 2 and to reduce variation in temperature on the peripheral surface 2S, the first magnetic member 33 is configured so that the end portions along the axis 10 of the heating roller 2 have a higher magnetic permeability ratio than that of the center portion. In other words, the magnetic permeability ratio of the magnetic members 33*b* and 33*d* that are outside the center magnetic member 33*c* is higher than that of the magnetic member 33*c* and the magnetic permeability ratio of the outermost magnetic members 33*a* and 33*e* is higher than that of the magnetic members 33*b* and 33*d*.

The first magnetic member 33 is formed of ferrite or another insulating material having a high magnetic permeability ratio so that the first magnetic member 33 itself does not receive magnetic flux and dissipate heat, which would lead to a loss in the amount of magnetic flux passing through the peripheral surface 2S of the heating roller 2.

As in the first embodiment, the elastic layer 44*c* is formed over the peripheral surface 44S of the pressure roller 44. Inside the elastic layer 44*c* are the magnetic layer 44*a*, and the core member 44*d* having the hollow area 44*b*.

A belt 35 is looped around the peripheral surface 44S of the pressure roller 44 on one end with respect to an axis 37 of the pressure roller 44 and a peripheral surface (not shown) of the rotational shaft of the driving source for communicating the rotational driving force of the driving source to the pressure roller 44.

The peripheral surface 44S of the pressure roller 44 is in pressure contact with the peripheral surface 2S of the heating roller 2 along the axis thereof. The peripheral surface 44S of the pressure roller 44 on both axial ends is supported in shaft receiving portions 36 that are formed in the attachment members 45A and 45B. The peripheral surfaces 44S of the pressure roller 44 and heating roller 2 pinch the recording paper P and convey the recording paper P in the direction of rotation.

The driving mechanism of the fixing device 31 includes a driving source (not shown) having a rotational shaft. The driving source is disposed outside the coil 9 wound around the support member 6. A mechanism is provided for communicating a rotational force of the driving source to the pressure roller 44 and the heating roller 2 as described below.

The rotation communicating mechanism of the fixing device 31 includes the driving source, such as a rotary motor, provided with the rotational shaft (not shown), the belt 35 looped around the rotational shaft of the driving source and the peripheral surface 44S of the pressure roller 44, the attachment members 45A and 45B that rotatably support the rotational shafts 20 of the heating roller 2 and the peripheral surface 44S of the pressure roller 4, and the pressure roller 44 that contacts the heating roller 2 with pressure. Since the belt 35 moves when the rotational shaft of the driving source rotates, the rotational force of the driving source is communicated to the pressure roller 44 via the belt 35. The rotational force of the pressure roller 44 is further communicated to the heating roller 2, and the heating roller 2 and the pressure roller 44 rotate together.

Next, the operations and effects of the fixing device 31 according to the second embodiment described above will be described.

In the fixing device 31 of the second embodiment, the first magnetic member 33 is supported on the supporting member 32 inside the hollow area 44*b* formed in the pressure roller 44. Hence, it is possible to increase the amount of magnetic flux passing through the peripheral surface 2S of the heating roller 2 by decreasing the amount of magnetic flux leaking out of the heating roller 2 without passing through the peripheral surface 2S, thereby improving the efficiency for heating the heating roller 2.

The hollow area 44*b* is provided in the pressure roller 44 for accommodating the first magnetic member 33. This improves production efficiency because a desired shape of the first magnetic member 33 can be selected as long as the first magnetic member 33 can be accommodated within the size and shape of the core member 44*d*, and because the first magnetic member 33 can be replaced.

As described above, the first magnetic member 33 in the fixing device 31 of the second embodiment is configured of the plurality of magnetic members 33*a*, 33*b*, 33*c*, 33*d*, and 33*e* disposed along the axis 10 of the heating roller 2. Further, the magnetic permeability ratio of the magnetic members 33*b* and 33*d* that are farther outside the center magnetic member 33*c* with respect to the axis 10 is greater than that of the magnetic member 33*c*, while the magnetic permeability ratio of the outermost magnetic members 33*a* and 33*e* is set higher than that of the magnetic members 33*b* and 33*d*. In this way, the peripheral surface 2S of the heating roller 2 can be heated uniformly across the axis 10.

Further, since the first magnetic member 33 includes the plurality of magnetic members 33*a*, 33*b*, 33*c*, 33*d*, and 33*e*, the surface temperature of the heating roller 2 and the efficiency for heating the peripheral surface 2S can easily be controlled by varying the magnetic permeability ratios of each magnetic member.

Since the first magnetic member 33 in the fixing device 31 according to the second embodiment is formed of an insulating material, a loss in heating efficiency caused by the first magnetic member 33 itself receiving magnetic flux and dissipating heat can be avoided, thereby improving the efficiency of heating the heating roller 2.

Next, an fixing device according to a third embodiment of the present invention will be described with reference to FIGS. 6 and 7.

Figure 6:
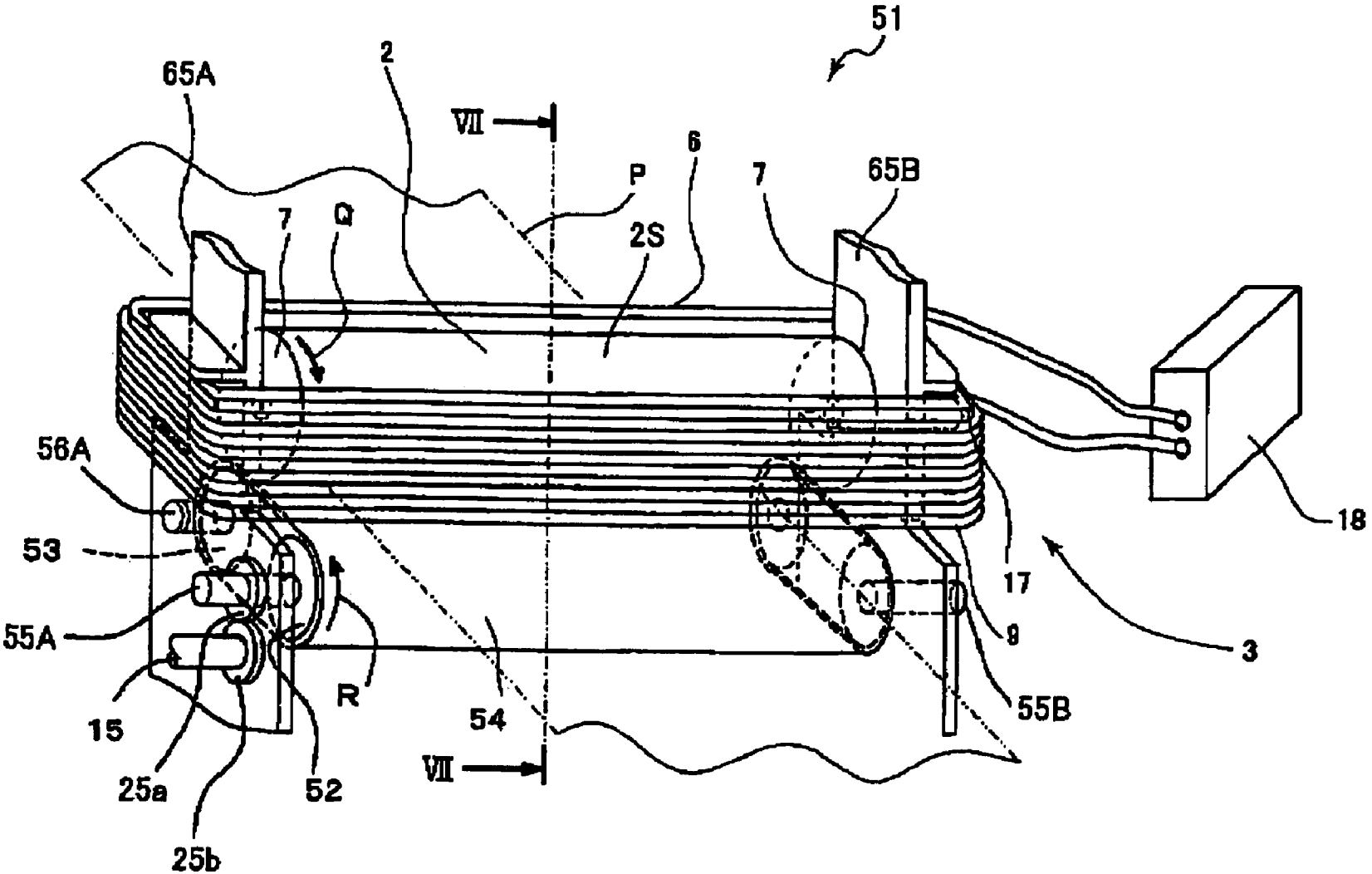
FIG. 6 is a perspective view showing the construction of a fixing device according to a third embodiment of the present invention.

FIG. 6 is a perspective view showing the construction of a fixing device 51 according to the third embodiment. FIG. 7 is a cross-sectional view as viewed from an arrow VII—VII of FIG. 6. Since the fixing device 51 of the third embodiment is similar in construction to the fixing device 1 of the first embodiment, only the features of the third embodiment will be described, and components common to the fixing device 1 and the fixing device 51 will not be described in detail.

Figure 7:
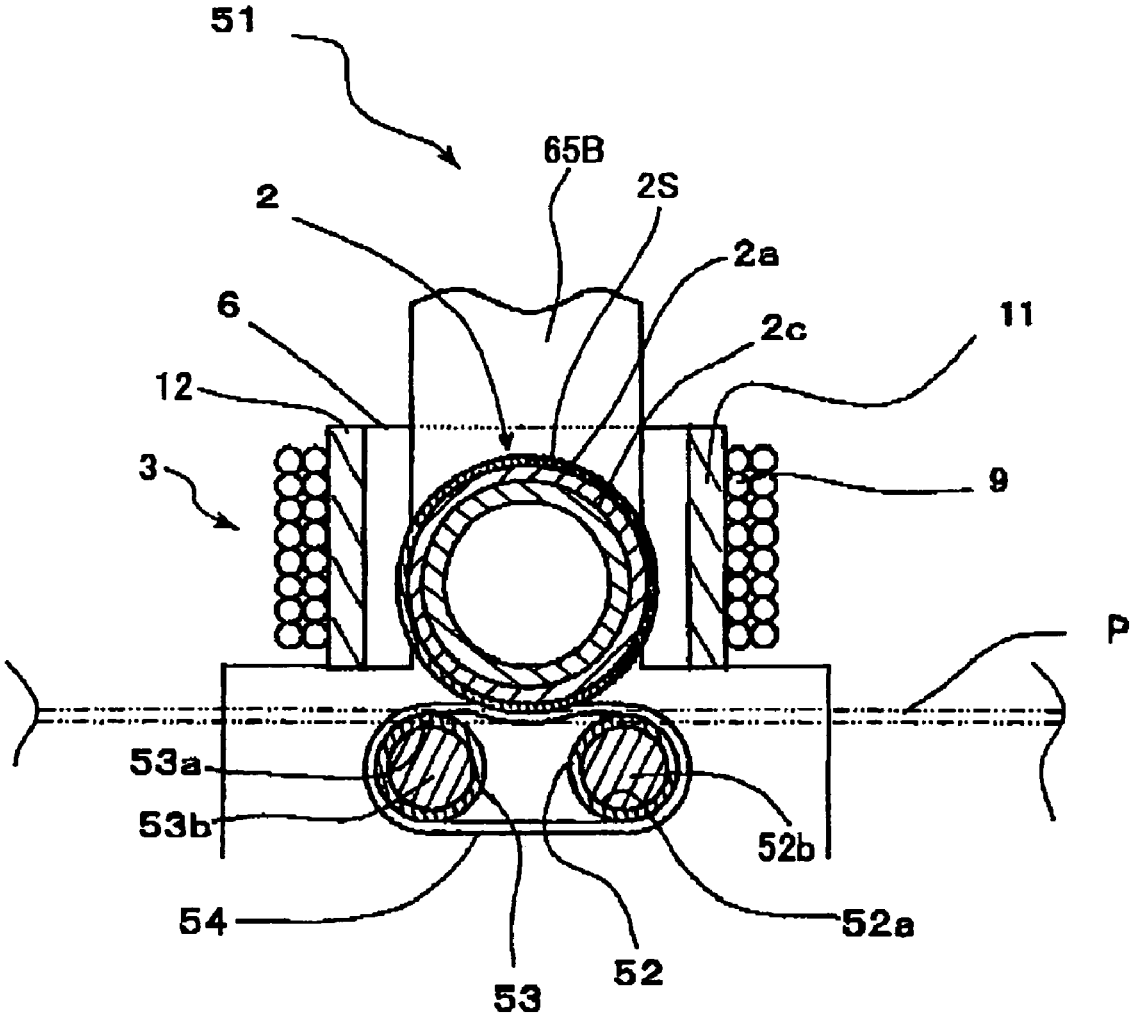
FIG. 7 is a cross-sectional view as viewed from an arrow VII—VII of FIG. 6.

As shown in FIGS. 6 and 7, the fixing device 51 includes the heating roller 2 that rotates in a circumferential direction Q, the heating device 3 for heating the heating roller 2 through electromagnetic induction, two rollers 52 and 53 that rotate about different rotational axes that are substantially parallel with each other, a pressure belt 54 that is looped around the two rollers 52 and 53 and contacts the peripheral surface 2S of the heating roller 2 for pinching the recording paper P against the heating roller 2 and conveying the recording paper P while moving circularly around the rollers 52 and 53, a driving mechanism for driving the pressure belt 54 and the heating roller 2, and the attachment members 65A and 65B for fixing the fixing device 51 at a predetermined position in the image forming device. In the fixing device 51, the recording paper P on which an image in toner or another developer has been transferred is pinched and conveyed by the nip part between the heating roller 2 and the pressure belt 54. The heat of the heating roller 2 melts the developer, fixing the developer on the recording paper P.

The pressure belt 54 is formed of a synthetic resin that is both flexible and insulating, so that the pressure belt 54 can pinch and convey the recording paper P together with the heating roller 2; the recording paper P can easily separate from the pressure belt 54; and the pressure belt 54 itself does not receive magnetic flux and dissipate heat, which can cause a drop in magnetic energy used to heat the heating roller 2.

As shown in FIG. 7, the rollers 52 and 53 are arranged in opposition to the heating roller 2 with the pressure belt 54 interposed therebetween. The rollers 52 and 53 are configured of core members 52*b* and 53*b* formed of an insulating material, and magnetic layers 52*a* and 53*a* formed over the surfaces of the core members 52*b* and 53*b*. The magnetic layers 52*a* and 53*a* are formed of ferrite or another insulating material to avoid receiving magnetic flux and dissipating heat, thereby preventing heating efficiency from deteriorating.

As shown in FIG. 6, rotational shafts 55A and 55B protrude from both axial ends of the rollers 52. Similarly, rotational shafts 56A and 56B (56B is not shown) protrude from both axial ends of the rollers 53. Shaft receiving portions (not shown) are formed in the attachment members 65A and 65B for rotatably supporting the rotational shafts 55A and 55B and rotational shafts 56A and 56B. With this construction, the rollers 52 and 53 can pinch the recording paper P against the peripheral surface 2S of the heating roller 2 and convey the recording paper P in the direction of rotation.

The fixing device 51 also includes a driving source (not shown) such as a rotary motor for driving the heating roller 2, the rollers 52 and 53, and the pressure belt 54. The driving source is connected to the rotational shaft 15 that is positioned outside the coil 9. A rotation communicating mechanism communicates the rotational force from the driving source to the pressure belt 54 and the heating roller 2.

The rotational shafts 55A and 55B of the roller 52 are supported in shaft receiving portions formed in the attachment members 65A and 65B and protrudes from the outer surface of the attachment members 65A and 65B, respectively. The rotational shafts 56A and 56B (56B is not shown) of the roller 53 are also supported in different shaft receiving portions formed in the attachment members 65A and 65B, but do not protrude from the attachment members 65A and 65B. The rotation communicating mechanism of the fixing device 51 is configured by connecting the protruding portion of the rotational shaft 55A to the rotational shaft 15 of the driving motor via the gears 25*a* and 25*b*. With this construction, the rotational force from the driving motor in the direction R is transferred to the pressure belt 54, which moves circularly around the outer surfaces of the rollers 52 and 53. Since the peripheral surface 2S of the heating roller 2 is in pressure contact with the pressure belt 54, the heating roller 2 rotates in the direction Q along with the pressure belt 54.

Next, the operations and effects of the fixing device 51 according to the third embodiment described above will be described.

In the fixing device 51 of the third embodiment, the magnetic layers 52*a* and 53*a* are formed over the peripheral surfaces of the rollers 52 and 53, and the pressure belt 54 is looped around the rollers 52 and 53, thereby improving the efficiency for heating the heating roller 2 through electromagnetic induction. In other words, the fixing device 51 can increase the amount of magnetic flux passing through the peripheral surface 2S of the heating roller 2 by reducing the amount of flux that leaks outside of the heating roller 2 without passing through the peripheral surface 2S, thereby obtaining a fixing device 51 having excellent efficiency in heating the heating roller 2.

Since the magnetic layers 52*a* and 53*a* are formed over the peripheral surface of the rollers 52 and 53 in the fixing device 51 of the third embodiment, there is no need to provide extra parts for increasing the amount of magnetic flux passing through the heating roller 2, thereby achieving good production efficiency.

Figure 8A:
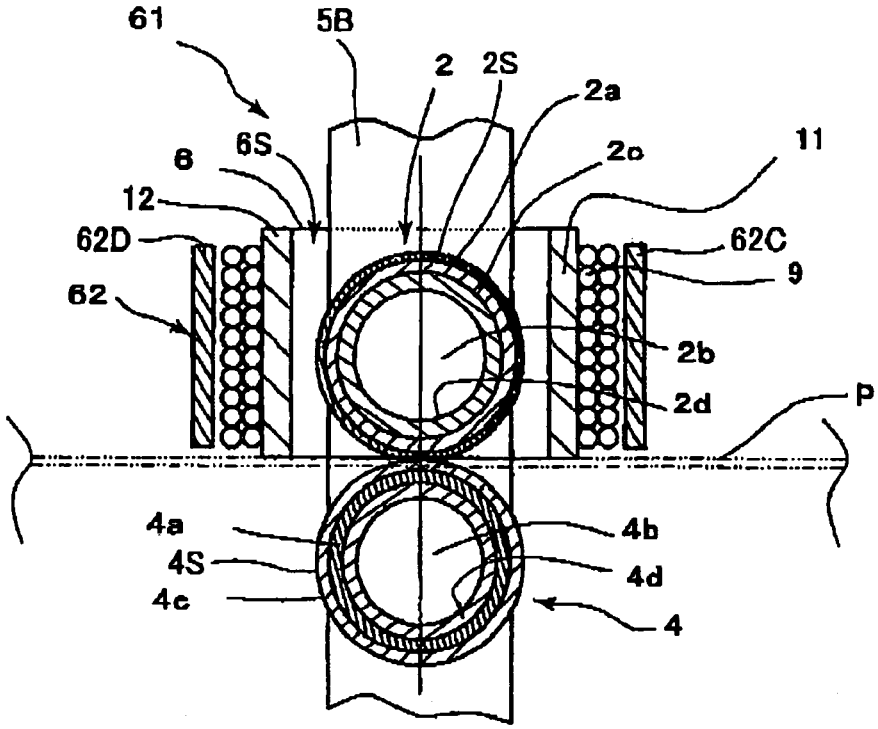
FIG. 8(*a*) is a cross-sectional view showing the construction of a fixing device according to a fourth embodiment of the present invention.
Figure 8B:
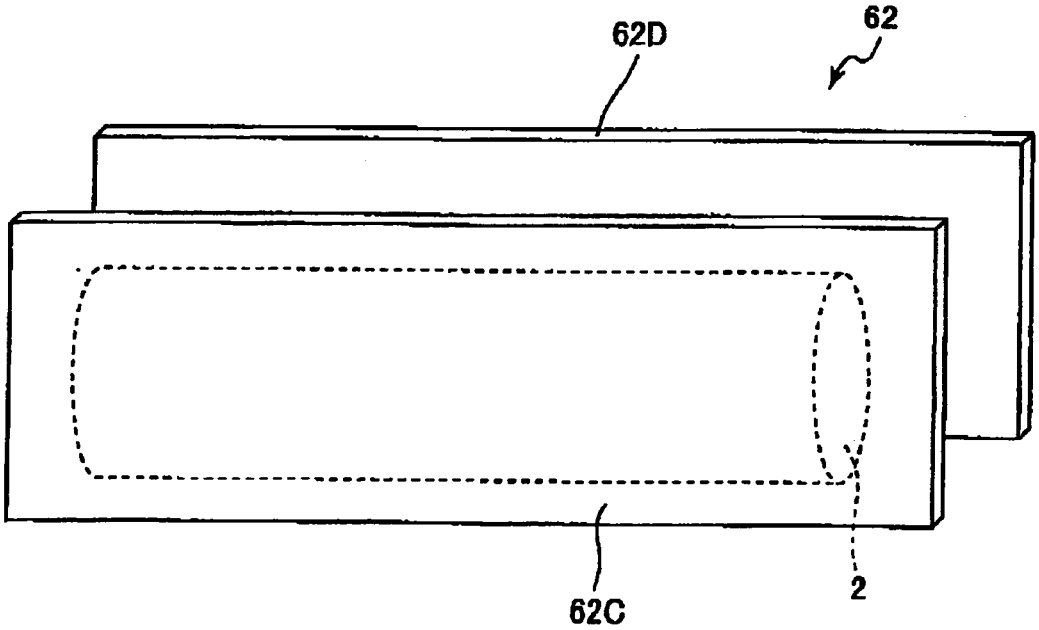

Next, a fixing device according to a fourth embodiment of the present invention will be described with reference to FIGS. 8(*a*) and 8(*b*). FIG. 8(*a*) is a cross-sectional view showing a fixing device 61 according to the fourth embodiment and corresponds to FIG. 2(*b*) of the first embodiment. FIG. 8(*b*) is an explanatory diagram (perspective view) showing a shape of a second magnetic member 62. Since the fixing device 61 of the fourth embodiment is similar in construction to the fixing device 1 of the first embodiment, only the features of the fourth embodiment will be described, and like parts and components are designated by the same reference numerals to avoid duplicating description.

As shown in FIG. 8(*a*), the fixing device 61 according to the fourth embodiment is configured similarly to the fixing device 1 of the first embodiment with the support member 6 disposed around the heating roller 2 and the coil 9 wound about the support member 6, so that the heating roller 2 is positioned in the space 6S surrounded by the support member 6 and the coil 9.

The fixing device 61 further includes the second magnetic member 62 surrounding the coil 9 for increasing the amount of flux that passes through the peripheral surface 2S of the heating roller 2 by decreasing the amount of flux leaking outside the coil 9. As shown in FIG. 8(*b*), the second magnetic member 62 is configured of side walls 62C and 62D disposed to surround the coil 9 and the heating roller 2 (the coil 9 is not shown in FIG. 8(*b*)). In other words, the coil 9 and the heating roller 2 are interposed between the side walls 62C and 62D. The side walls 62C and 62D are fixed to the support member 6 by a mounting piece (not shown). The second magnetic member 62 is formed of ferrite or another magnetic material that is insulating and has high magnetic permeability so that the second magnetic member 62 itself does not dissipate heat, which can reduce the amount of magnetic flux passing through the peripheral surface 2S of the heating roller 2.

As in the first embodiment, the elastic layer 4*c* is formed along the peripheral surface 4S of the pressure roller 4, while the inner portion of the pressure roller 4 includes the core member 4*d* formed with the hollow area 4*b*, the magnetic layer 4*a*, and the like.

Next, the operations and effects of the fixing device 61 according to the fourth embodiment described above will be described.

Since the fixing device 61 according to the fourth embodiment includes the magnetic layer 4*a* formed over the peripheral surface 4S of the pressure roller 4 and the second magnetic member 62 surrounding the coil 9, the fixing device 61 can further increase the amount of magnetic flux passing through the peripheral surface 2S of the heating roller 2 by further decreasing the amount of flux leaking outside of the heating roller 2, thereby improving the efficiency for heating the heating roller 2.

Since the second magnetic member 62 is formed of an insulating material in the fixing device 61 of the fourth embodiment, heating efficiency is not decreased by the fixing device 61 itself receiving magnetic flux and dissipating heat, thereby improving the efficiency for heating the heating roller 2.

Figure 9:
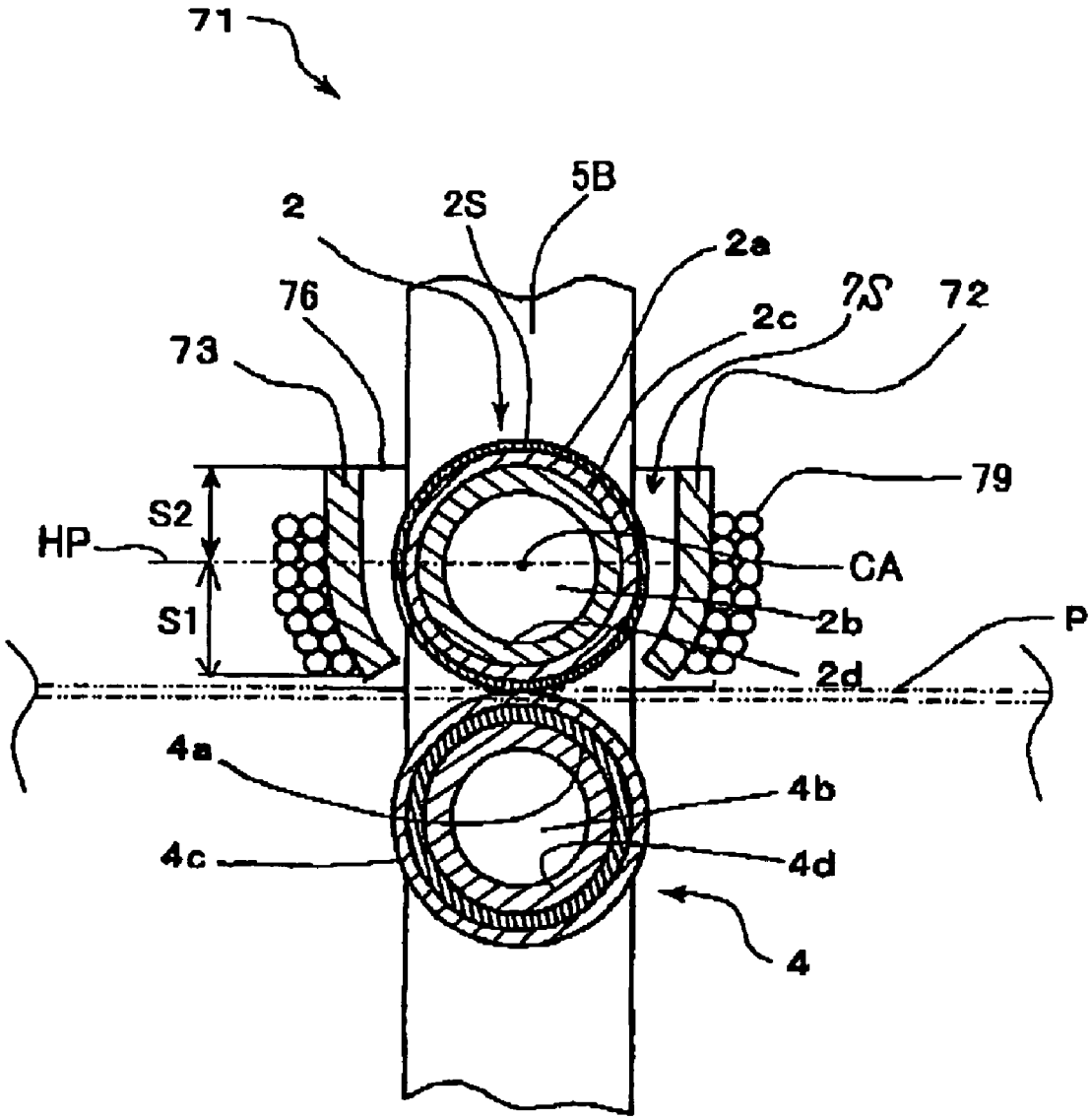
FIG. 9 is a cross-sectional view showing the construction of a fixing device according to a fifth embodiment of the present invention.

Next, a fixing device according to a fifth embodiment of the present invention will be described with reference to FIG. 9. FIG. 9 is a cross-sectional view showing the construction of a fixing device 71 according to the fifth embodiment. FIG. 9 corresponds to FIG. 2(*b*) of the first embodiment. Since the fixing device 71 of the fifth embodiment is similar in construction to the fixing device 1 of the first embodiment, only the features of the fifth embodiment will be described, and components common to the fixing device 1 and the fixing device 71 will not be described in detail.

As shown in FIG. 9, the fixing device 71 according to the fifth embodiment is configured similarly to the fixing device 1 of the first embodiment with a support member 76 disposed around the heating roller 2 and a coil 79 wound about the support member 76, so that the heating roller 2 is positioned in a space 7S surrounded by the support member 76 and the coil 79.

In the fifth embodiment, the support member 76 includes side walls 72 and 73 that oppose each other with the heating roller 2 interposed therebetween. The portion of the side walls 72 and 73 indicated by a portion S1 from the points intersected by a horizontal plane HP passing through a central axis CA of the heating roller 2 to the ends nearer the pressure roller 4 is formed in a curve that follows the peripheral surface 2S of the heating roller 2 so as to approach the magnetic layer 4*a* of the pressure roller 4. The remaining portion indicated by a portion S2 of the side walls 72 and 73 from the points intersected by the horizontal plane HP away from the pressure roller 4 are formed parallel to each other.

The coil 79 is wound around the outer surfaces of the side walls 72 and 73. Hence, the portion S1 of the coil 79 from a point intersected by the horizontal plane HP toward the pressure roller 4 slants toward the magnetic layer 4*a* of the pressure roller 4.

Next, the operations and effects of the fixing device 71 according to the fifth embodiment described above will be described. Since the coil 79 of the fixing device 71 according to the fifth embodiment slants toward the magnetic layer 4*a* of the pressure roller 4 below the horizontal plane HP, the amount of magnetic flux passing through the peripheral surface 2S of the heating roller 2 is larger than when the coil 79 is separated farther from the magnetic layer 4*a*, thereby further improving the efficiency for heating the heating roller 2.

Figure 10:
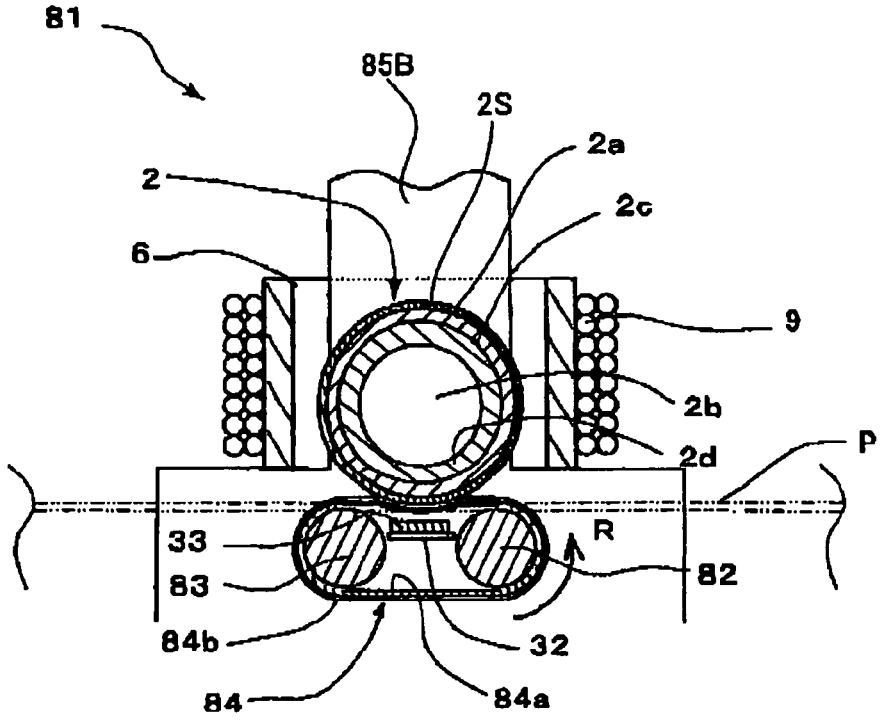
FIG. 10 is a cross-sectional view showing the construction of a fixing device according to a sixth embodiment of the present invention.

Next, a fixing device according to a sixth embodiment of the present invention will be described with reference to FIG. 10. FIG. 10 is a cross-sectional view showing the construction of a fixing device 81 according to the sixth embodiment and corresponds to FIG. 7 of the third embodiment. Since the fixing device 81 of the sixth embodiment is similar in construction to the fixing device 51 (FIG. 7) of the third embodiment, only the features of the sixth embodiment will be described, and components common to the fixing device 51 and the fixing device 81 will not be described in detail.

As shown in FIG. 10, a fixing device 81 according to the sixth embodiment includes two rollers 82 and 83 and a pressure belt 84 looped around the rollers 82 and 83. The recording paper P on which developer has been transferred is pinched between the heating roller 2 and the pressure belt 84 and conveyed as the pressure belt 84 moves circularly around the rollers 82 and 83. At this time, the developer is fixed onto the recording paper P by the heating roller 2.

The first magnetic member 33 is supported on the supporting member 32 and is disposed inside the pressure belt 84 and faces the heating roller 2 in order to increase the amount of flux that passes through the peripheral surface 2S of the heating roller 2. The supporting member 32 protrudes outside of the pressure belt 84 in the axial direction orthogonal to the direction R in which the pressure belt 84 moves. Both ends of the supporting member 32 are fixed to the attachment members 85A and 85B (85A is not shown), similarly as shown in FIG. 4 of the second embodiment.

The pressure belt 84 is configured of an elastic layer 84*b* and a magnetic layer 84*a*. The elastic layer 84*b* is formed on the outside surface of the pressure belt 84. The elastic layer 84*b* is formed of rubber or another elastic material so that the recording paper P pinched and conveyed between the pressure belt 84 and the heating roller 2 can easily separate from the pressure belt 84. The magnetic layer 84*a* is formed on the inside surface of the pressure belt 84 for improving heating efficiency by increasing the amount of magnetic flux passing through the heating roller 2. The magnetic layer 84*a* is formed of ferrite or another insulating material that does not receive flux and dissipate heat so as not to reduce heating efficiency.

Next, the operations and effects of the fixing device 81 according to the sixth embodiment described above will be described.

By disposing the first magnetic member 33 inside the pressure belt 84 and opposing the heating roller 2, the fixing device 81 of the sixth embodiment can increase the amount of flux passing through the peripheral surface 2S of the heating roller 2 by decreasing the amount leaking outside of the heating roller 2, thereby improving the efficiency for heating the heating roller 2. Further, by forming the magnetic layer 84*a* along the inner surface of the pressure belt 84, it is possible to further increase the amount of magnetic flux passing through the peripheral surface 2S of the heating roller 2, thereby further improving efficiency for heating the heating roller 2.

Figure 11:
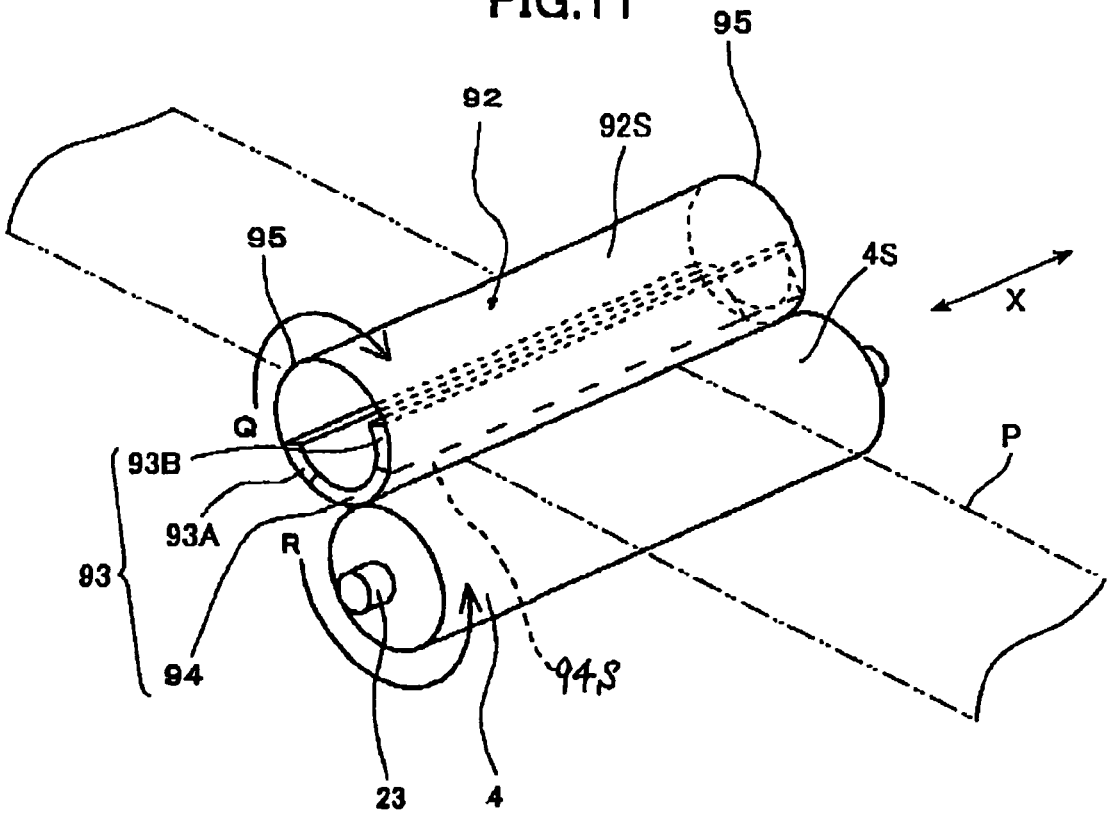
FIG. 11 is a perspective view showing the construction of a heating member and a pressure roller of a fixing device according to a seventh embodiment of the present invention.
Figure 12:
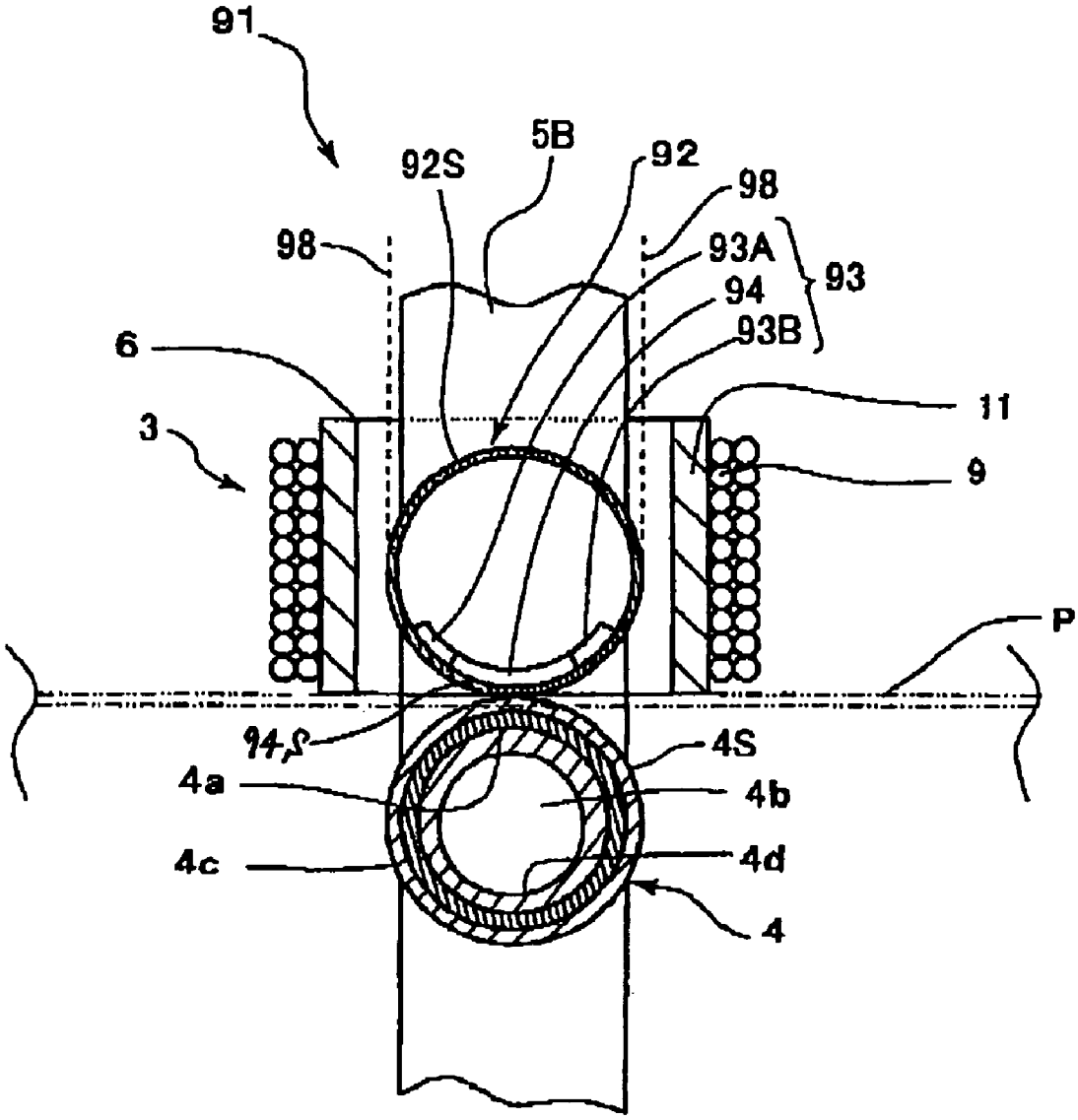
FIG. 12 is a cross-sectional view showing the construction of the fixing device according to the seventh embodiment.

Next, a fixing device according to a seventh embodiment of the present invention will be described with reference to FIGS. 11 and 12. FIG. 11 is a perspective view showing the construction of a heating roller and a pressure roller in a fixing device 91 according to the seventh embodiment. FIG. 12 is a cross-sectional view of the fixing device 91 according to the seventh embodiment and corresponds to FIG. 2(*b*) of the first embodiment. Since the fixing device 91 of the seventh embodiment is similar in construction to the fixing device 1 of the first embodiment, only the features of the seventh embodiment will be described, and components common to the fixing device 1 and the fixing device 91 will not be described in detail.

As shown in FIGS. 11 and 12, the fixing device 91 includes a guide member 93, a heating member 92, the pressure roller 4, the heating device 3 (FIG. 12), and the attachment members 5A and 5B (the attachment member 5A is not shown in FIG. 12).

The guide member 93 is substantially shaped like a half cylinder and includes support portions 93A and 93B and an interposed portion 94. The interposed portion 94 is supported by the support portions 93A and 93B between the same. The support portions 93A and 93B are formed of an insulating resin that is nonmagnetic, nonconductive, and heat resistant, in order to increase the heating efficiency of the heating device 3. The interposed portion 94 has a smooth surface 94S in contact with the heating member 92, in order to facilitate sliding of the heating member 92.

The heating member 92 is formed of a cylindrical film that is slidably disposed over the peripheral surface of the guide member 93. The pressure roller 4 is disposed parallel to and in contact with the peripheral surface 92S of the heating member 92 for pinching and conveying the recording paper P in cooperation with the heating member 92. The heating device 3 is for heating the heating member 92 through electromagnetic induction. The attachment members 5A and 5B are for fixing the fixing device 91 at a predetermined position in the image forming device.

In the fixing device 91 having the above-described construction, the recording paper P on which developer such as toner has been transferred is pinched and conveyed by the nip part between the heating member 92 and the pressure roller 4, whereby the developer is melted and fixed onto the recording paper P.

The heating member 92 is formed of a conductive and magnetic thin metal film, such as a carbon steel, nickel, or stainless steel film having a thickness of 50 μm, to be heated by the heating device 3.

The heating member 92 is fitted over the semi-cylindrical guide member 93 and is capable of sliding over the peripheral surface of the guide member 93. The heating member 92 is disposed so that the peripheral surface 92S of the heating member 92 contacts the pressure roller 4 along an axial direction X. The rotation of the pressure roller 4 is transferred to the heating member 92 causing the heating member 92 to rotate around the peripheral surface of the guide member 93 in the rotational direction Q in FIG. 11.

As in the first embodiment, one of the rotational shafts 23 on the pressure roller 4 is connected to the rotational shaft of a drive motor (not shown) via gears. With this construction, rotational force from the drive motor in the rotational direction R is transferred to the pressure roller 4. Since the peripheral surface 4S of the pressure roller 4 contacts the peripheral surface 92S of the heating member 92, a rotational force in the rotational direction Q in FIG. 11 is transferred to the heating member 92.

As in the first embodiment, the heating device in the present embodiment includes the coil 9 wound in a rectangular-tube shape around the heating member 92 with a gap formed therebetween. The coil 9 is formed around the periphery of the heating member 92 that includes both end portions 95 of the heating member 92 and both imaginary side planes 98 that are parallel to the axial direction X.

As in the first embodiment, the pressure roller 4 includes the core member 4*d* formed of an insulating resin that is nonmagnetic, nonconductive, and heat-resistant. The core member 4*d* has the hollow area 4*b*. The magnetic layer 4*a* is formed over the core member 4*d* for increasing the amount of magnetic flux passing through the peripheral surface 92S of the heating roller 92, and the elastic layer 4*c* is formed over the magnetic layer 4*a*. The magnetic layer 4*a* is formed of an insulating material such as ferrite having a high magnetic permeability ratio so as to prevent a drop in the amount of magnetic flux passing through the heating roller 92 caused by the magnetic layer 4*a* itself receiving magnetic flux and dissipating heat.

As in the first embodiment, the heating device 3 of the fixing device 91 includes a driving source (not shown) having a rotational shaft outside of the coil 9, which is wound around the support member 6. A rotation communicating mechanism is configured to transfer the rotational force from the driving source to the pressure roller 4 and to the heating member 92.

Next, the operations and effects of the fixing device 91 according to the seventh embodiment described above will be described.

By forming the heating member 92 as a film, the fixing device 91 according to the seventh embodiment can reduce the heating capacity required to raise the temperature of the heating member 92 to the fixing temperature, enabling the fixing temperature to be reached quickly after actuating the heating device 3 and reducing temperature variation in the heating member 92 in order to perform efficient heating. Further, by providing the magnetic layer 4*a* along the peripheral surface 4S of the pressure roller 4, it is possible to increase the amount of magnetic flux passing through the heating member 92 by reducing the amount of flux leaking outside of the heating member 92, thereby improving the efficiency of heating the heating member 92.

Figure 13:
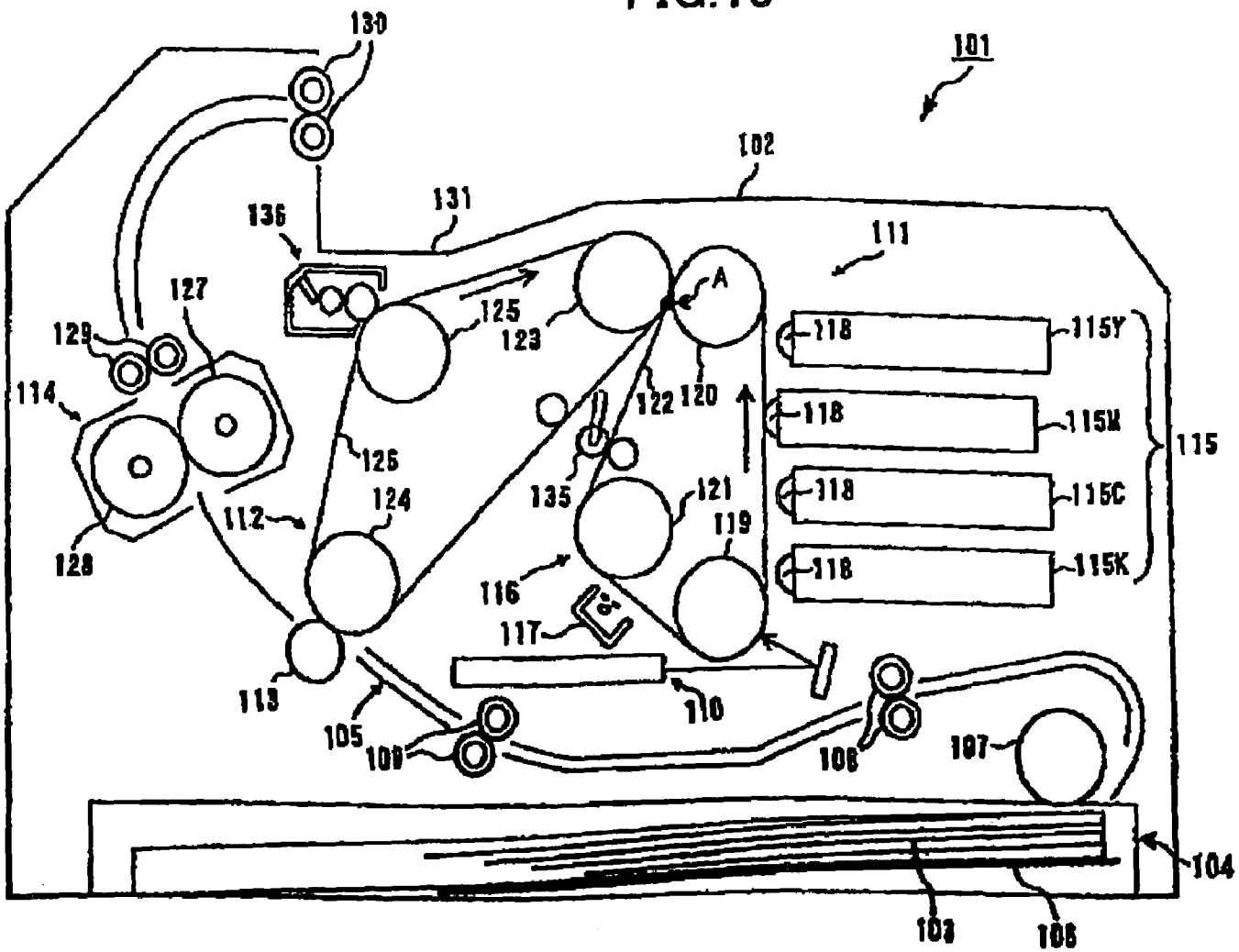
FIG. 13 is a side view conceptually showing the construction of a color laser printer employing the fixing device according to the embodiments of the present invention.

Next, an image forming device employing the fixing device will be described with reference to FIG. 13. FIG. 13 is an explanatory diagram showing the construction of a color laser printer 101 employing the fixing device 1, 31, 51, 61, 71, 81, or 91 according to the first through seventh embodiments described above.

As shown in FIG. 13, the color laser printer 101 includes a main casing 102 and, within the main casing 102, a feeder unit 104 for feeding sheets of a recording paper 103, an image forming unit 105 for forming predetermined images on the recording paper 103 supplied from the feeder unit 104, and the like.

Sheets of the recording paper 103 are stacked on a paper supply tray 106 disposed in the feeder unit 104. The topmost sheet of the recording paper 103 stacked on the paper supply tray 106 is supplied one sheet at a time by the rotation of a feed roller 107 and conveyed to the image forming unit 105 by conveying rollers 108 and registration rollers 109.

The image forming unit 105 includes a scanning unit 110 for forming latent images based on predetermined image data by scanning a laser light over the surface of a photosensitive belt 122 described later, a processing unit 111 for transferring developer such as toner onto the photosensitive belt 122, an intermediate transfer belt mechanism 112, a transfer roller 113, and a fixing unit 114.

The scanning unit 110 includes a laser light emitting element, a polygon mirror, and a plurality of lenses and reflecting mirrors (not shown). In the scanning unit 110, the laser light emitting element emits a laser beam based on predetermined image data. The laser beam passes through or reflects off of the reflecting mirrors and lenses and is irradiated in a high-speed scanning motion onto the surface of the photosensitive belt 122 in a photosensitive belt mechanism 116 described later.

The processing unit 111 includes developing cartridges 115, the photosensitive belt mechanism 116, and a Scorotron charging device 117.

In the present embodiment, four developing cartridges 115 are provided to include a yellow developing cartridge 115Y for supplying yellow toner, a magenta developing cartridge 115M for supplying magenta toner, a cyan developing cartridge 115C for supplying cyan toner, and a black developing cartridge 115K for supplying black toner.

Each of the developing cartridges 115 includes a toner accommodating section for accommodating a positively charged toner of the colors yellow, magenta, cyan, and black, respectively. Each developing cartridge 115 also includes a supply roller (not shown) that rotates to supply toner onto a developing roller 118. The toner carried on the developing roller 118 is regulated at a uniform thin layer by a thickness-regulating blade (not shown). At this time, the toner is positively charged and is, thus, attracted to the surface of the developing roller 118 by electrostatic force.

The photosensitive belt mechanism 116 includes a first photosensitive belt roller 119, a second photosensitive belt roller 120, and a third photosensitive belt roller 121 that are disposed in a triangular arrangement. The photosensitive belt 122 is looped around these three rollers.

The photosensitive belt 122 is formed of a synthetic resin such as polyethylene terephthalate (PET) on the surface of which aluminum has been deposited. An organic photosensitive layer is provided on the surface of the photosensitive belt 122.

When a driving source (not shown) drives the second photosensitive belt roller 120 to rotate, the photosensitive belt 122 moves circularly counterclockwise in FIG. 12. While rotating circularly, the photosensitive belt 122 is exposed to laser light from the scanning unit 110, whereby an electrostatic latent image is formed on the surface of the photosensitive belt 122. Next, the latent image on the photosensitive belt 122 comes into contact with the developing rollers 118 carrying positively charged toner, and the latent image is developed into a toner image.

When the second photosensitive belt roller 120 is driven to rotate, the photosensitive belt 122 moves circularly and the first photosensitive belt roller 119 and third photosensitive belt roller 121 follow the rotation of the second photosensitive belt roller 120.

The intermediate transfer belt mechanism 112 is disposed adjacent to the photosensitive belt mechanism 116. The intermediate transfer belt mechanism 112 includes a first intermediate transfer belt roller 123 disposed in confrontation with the second photosensitive belt roller 120 through the photosensitive belt 122 and an intermediate transfer belt 126, a second intermediate transfer belt roller 124 disposed in confrontation with the transfer roller 113 described later through the intermediate transfer belt 126, a third intermediate transfer belt roller 125 disposed in a position forming a triangle with the first intermediate transfer belt roller 123 and the second intermediate transfer belt roller 124, and the intermediate transfer belt 126 looped around the three intermediate transfer belt rollers.

The intermediate transfer belt 126 is formed of a heat-resistant synthetic resin in which have been dispersed conductive particles such as carbon. The intermediate transfer belt 126 moves circularly clockwise in FIG. 13, while contacting the photosensitive belt 122 at a transfer position A. The toner image formed on the photosensitive belt 122 is transferred to the intermediate transfer belt 126 at the transfer position A. In the present embodiment, four colors of toner are used. Therefore, as the photosensitive belt 122 continues moving circularly, a cleaning roller 135 connected to a charge remover cleans the photosensitive belt 122. Subsequently, the Scorotron charging device 117 recharges the photosensitive belt 122. Next, an electrostatic latent image for the next color is formed on the photosensitive belt 122 and is developed into a toner image. This toner image is superimposed over the toner image previously transferred onto the intermediate transfer belt 126. A four-color image is transferred onto the intermediate transfer belt 126 by repeating this process for each of the four colors.

The transfer roller 113 is movably disposed at a position opposing the second intermediate transfer belt roller 124 with the intermediate transfer belt 126 interposed therebetween, so that the transfer roller 113 can contact or separate from the surface of the intermediate transfer belt 126. When the recording paper 103 is being conveyed, the transfer roller 113 is moved into contact with the intermediate transfer belt 126, and a predetermined transfer bias is applied to the transfer roller 113. The four-color image formed on the intermediate transfer belt 126 is transferred all at once onto the recording paper 103 as the recording paper 103 passes between the intermediate transfer belt 126 and the transfer roller 113.

At this time, the color image transferred on the recording paper 103 is not fixed yet. Next, the recording paper 103 is conveyed to the fixing unit 114 for fixing the color image on the recording paper 103.

The fixing unit 114 has a construction equivalent to any of the fixing devices 1, 31, 51, 61, 71, 81, or 91 according to the first through seventh embodiments described above. The fixing unit 114 includes a heating roller 127 and a pressure roller 128 for fixing the color image on the recording paper 103 as the recording paper 103 passes therebetween.

After the color image is fixed on the recording paper 103 in the fixing unit 114, conveying rollers 129 convey the recording paper 103 toward discharge rollers 130. The discharge rollers 130 discharge the recording paper 103 onto a discharge tray 131.

Since the image forming device 101 according to the eighth embodiment described above employs the fixing unit 114 having a construction equivalent to that described in any of the first through seventh embodiments and, hence, having good heating efficiency, the image forming device 101 can uniformly fix the developer on the recording paper 103 to obtain an image that has been reproduced and fixed well.

While the invention has been described in detail with reference to the specific embodiment thereof, it would be apparent to those skilled in the art that various changes and modifications may be made therein without departing from the spirit of the invention.

Figure 14:
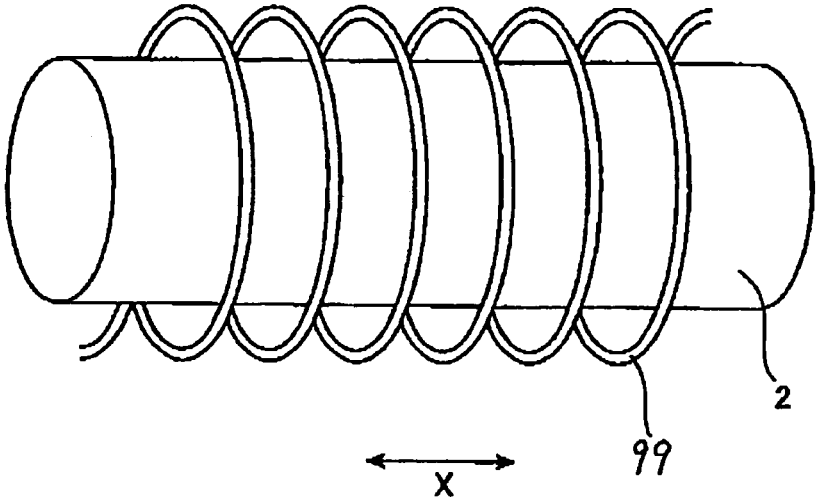
FIG. 14 is an explanatory diagram showing a modification in which a coil is wound around a heating roller such that a winding axis of the coil is parallel with an axial direction of the heating roller.

For example, in the fixing device 1 according to the first embodiment (FIG. 1), the coil 9 is wound around the heating roller 2, such that the winding axis of the coil 9 is perpendicular to the axial direction X of the heating roller 2. However, as shown in a conceptual diagram of FIG. 14, a coil 99 may also be wound around the heating roller 2, such that the winding axis of the coil 99 is parallel with the axial direction X of the heating roller 2.

Further, in the fixing device 31 of the second embodiment (FIG. 4), the plurality of magnetic members 33*a*, 33*b*, 33*c*, 33*d*, and 33*e* making up the first magnetic member 33 is provided on the top surface of the supporting member 32 and the magnetic permeability ratio grows larger from the center magnetic member 33*c* toward the magnetic members 33*a* and 33*e* on the ends. However, the first magnetic member 33 may be provided as a single member, rather than being divided into a plurality of magnetic members, while having a magnetic permeability ratio that grows larger from the center toward the ends.

In the fixing device 51 according to the third embodiment (FIG. 7), two rollers 52 and 53 having magnetic layers 52*a* and 53*a* are disposed inside the pressure belt 54. However, the number of rollers is not limited to two, but may be increased to a larger number. In that case, a magnetic layer may be provided in selected rollers for improving heating efficiency, rather than providing the magnetic layer in all of the rollers.

In the fixing device 61 according to the fourth embodiment (FIGS. 8(*a*) and 8(*b*)), the second magnetic member 62 is disposed to surround the coil 9. However, the second magnetic member 62 may be extended to surround the pressure roller 4 as well. This construction can further improve efficiency for heating the heating roller 2.

Figure 15A:
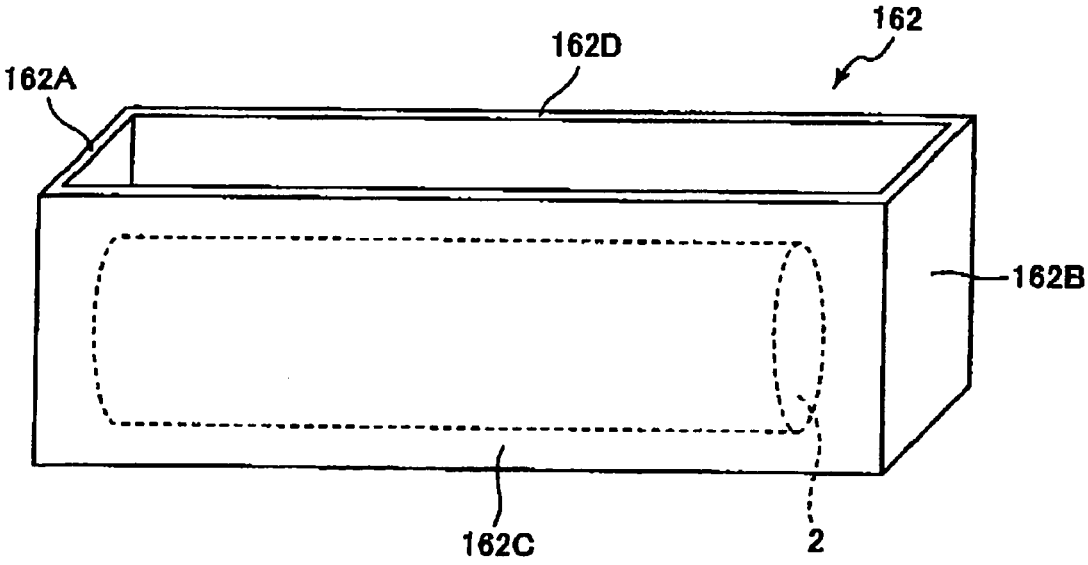
FIG. 15(*a*) is an explanatory diagram showing a modification in which a second magnetic member is configured of four walls and has a rectangular-tube shape.
Figure 15B:
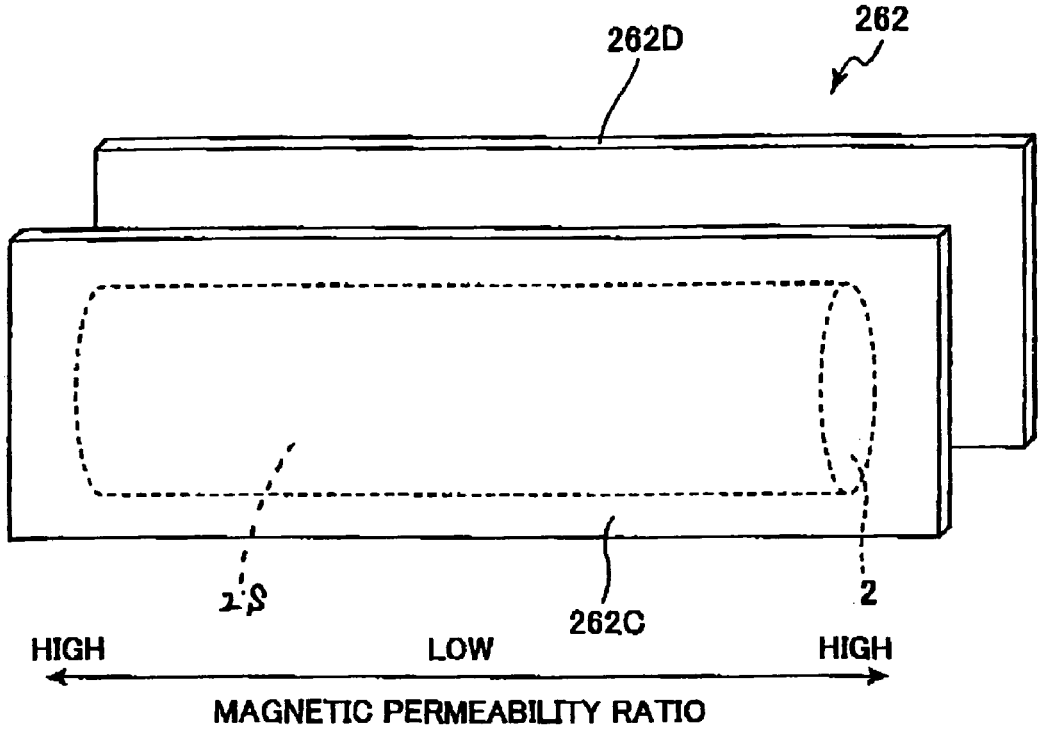
Figure 15C:
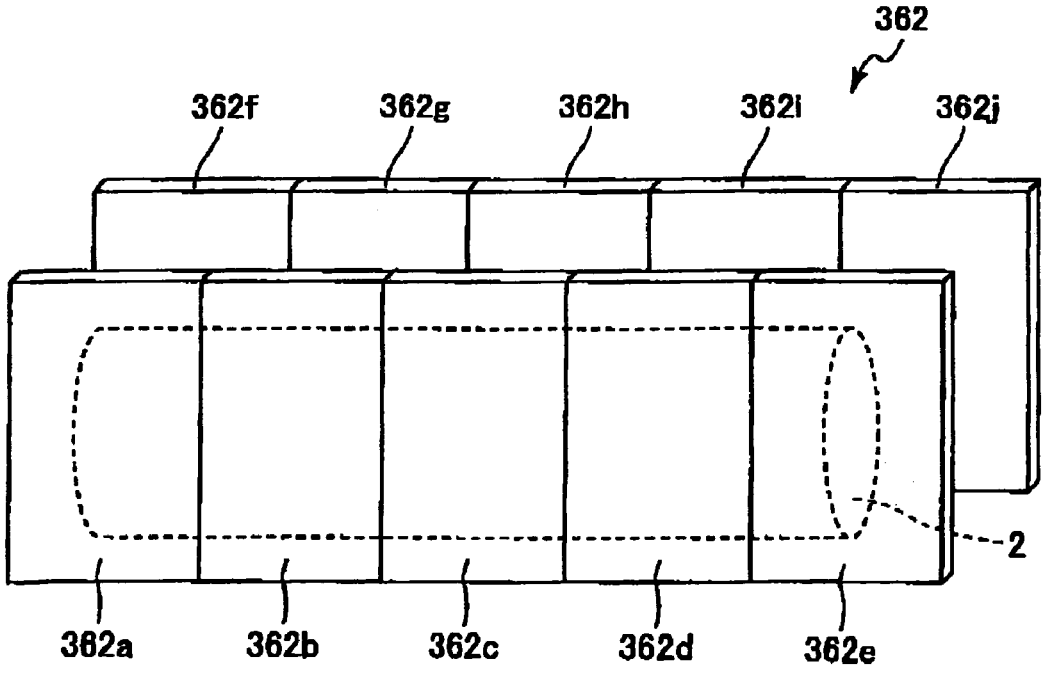

In the fixing device 61 according to the fourth embodiment (FIGS. 8(*a*) and 8(*b*)), the second magnetic member 62 is configured of the two side walls 62C and 62D. As shown in FIG. 15(*a*), however, a second magnetic member 162 is configured of end walls 162A and 162B and side walls 162C and 162D all made from a magnetic material, thereby forming a rectangular-tube shape surrounding the coil 9 and the heating roller 2. The second magnetic member 162 has the same effect as the second magnetic member 62, that is, the second magnetic member 162 can increase the amount of flux that passes through the peripheral surface 2S of the heating roller 2. Alternatively, the end walls 162A and 162B may be made from a non-magnetic material, in which case the end walls 162A and 162B are provided for connecting the side walls 162C and 162D.

In the fixing device 61 according to the fourth embodiment (FIGS. 8(*a*) and 8(*b*)), the magnetic permeability ratio of the second magnetic member 62 is constant along the axial direction of the heating roller 2. As shown in FIG. 15(*b*), however, the magnetic permeability ratio of a second magnetic member 262 is varied along the axial direction of the heating roller 2. In other words, the magnetic permeability ratio of the second magnetic member 262 is higher on the both end portions than in the center portion with regard to the axial direction of the heating roller 2. With this construction, it is possible to improve efficiency of heating the heating roller 2 and to reduce temperature variations on the peripheral surface 2S of the heating roller 2.

In another modification shown in FIG. 15(*c*), a second magnetic member 362 is formed dividedly to provide a plurality of magnetic member portions 362*a* through 362*j* that is arranged along the axial direction of the heating roller 2. The second magnetic member 362 is configured so that the end portions along the axial direction of the heating roller 2 have a higher magnetic permeability ratio than that of the center portion. In other words, the magnetic permeability ratio of the magnetic member portions 362*b* and 362*d* that are outside the center magnetic member portion 362*c* is higher than that of the magnetic member portion 362*c* and the magnetic permeability ratio of the outermost magnetic member portions 362*a* and 362*e* is higher than that of the magnetic member portions 362*b* and 362*d*. The same goes for the magnetic member portions 362*f* through 362*j*. With this construction, it is possible to obtain effect similar to that obtained by the second magnetic member 262 shown in FIG. 15(*b*).

Further, although the coil 9 in the embodiments described above is wound around the outer periphery of the support member 6, the coil 9 may instead be wound along the inner surface of the support member 6.

Further, the thickness and surface area for portions of the first and second magnetic members opposing the heating roller 2 may be varied along the axial direction X of the heating roller 2 in order to increase the amount of flux passing through the heating roller 2 and improve heating efficiency.

While the image forming device according to the eighth embodiment forms four-color images, the image forming device may also be a type that forms single-color images. Further, the image forming device according to the eighth embodiment described above forms a color image on one surface of the recording paper 103. However, after fixing the color image on one side of the recording paper 103, the recording paper 103 may be inverted to form a color image on the reverse side thereof.

What is claimed is:

1. A fixing device for fixing a developer onto a recording medium, the device comprising:

a heating member having a surface and rotatable about an axis, the axis extending in an axial direction;

a magnetic-flux generating unit including:

a coil disposed outside the heating member; and a current supplying unit supplying the coil with a current, thereby generating magnetic flux for heating the heating member through electromagnetic induction effect; and a pressing member in pressure contact with the heating member and pinching and conveying the recording medium in cooperation with the heating member in order to fix the developer on the recording medium, the pressing member including a first magnetic member that increases an amount of the magnetic flux that passes through the surface of the heating member, wherein the pressing member is formed with a hollow portion;

wherein the first magnetic member is disposed inside the hollow portion, the first magnetic member being provided as a separate member from the pressing member, the first magnetic member not rotating with the pressing member;

wherein the coil is disposed outside the pressing member, wherein a hollow space is defined inside the coil, and wherein the heating member is positioned in the hollow space of the coil; and wherein the coil is disposed at a position that is shifted, by a predetermined length, toward the first magnetic member from a position at which the axis of the heating member is positioned.

2. The fixing device as claimed in claim 1, wherein the pressing member comprises a pressure roller rotatable about a rotational axis.

3. The fixing device as claimed in claim 1, wherein the pressing member includes:

at least two rollers rotatable about different rotational axes that are substantially parallel with each other; and a pressure belt looped around the at least two rollers and movable circularly around the at least two rollers; and wherein the hollow portion is formed between the at least two rollers and inside a loop of the pressure belt.

4. The fixing device as claimed in claim 3, wherein the first magnetic member is disposed at a position confronting the heating member through the pressure belt.

5. The fixing device as claimed in claim 1, wherein the first magnetic member extends along the axial direction of the heating member;

wherein the first magnetic member has a center portion and end portions with respect to the axial direction; and wherein the first magnetic member has a larger magnetic permeability ratio on the end portions than in the center portion.

6. The fixing device as claimed in claim 5, wherein the first magnetic member includes a plurality of magnetic members arranged along the axial direction of the heating member.

7. The fixing device as claimed in claim 1, wherein the first magnetic member is formed of an insulating material.

8. The fixing device as claimed in claim 1, further comprising a second magnetic member disposed to surround the coil.

9. The fixing device as claimed in claim 8, wherein the second magnetic member extends along the axial direction of the heating member and has a center portion and end portions with respect to the axial direction; and wherein the second magnetic member has a greater magnetic permeability ratio on the end portions than in the center portion.

10. The fixing device as claimed in claim 9, wherein the second magnetic member includes a pair of elongated walls disposed to interpose the coil therebetween, each elongated wall extending along the axial direction; and wherein each elongated wall has a greater magnetic permeability ratio on the end portions than in the center portion.

11. The fixing device as claimed in claim 9, wherein the second magnetic member is formed dividedly to provide a plurality of magnetic member portions arranged along the axial direction of the heating member.

12. The fixing device as claimed in claim 8, wherein the second magnetic member is formed of an insulating material.

13. The fixing device as claimed in claim 1, wherein the heating member and the pressing member are aligned with each other in an alignment direction;

wherein the heating member is a substantially cylindrical member having a peripheral surface surrounding an axis and two end surfaces substantially perpendicular to the axis; and wherein the coil encloses the heating member in a cross section of the heating member and the coil, the cross section being perpendicular to the alignment direction.

14. The fixing device as claimed in claim 13, further comprising attachment members at positions where each attachment member confronts a corresponding one of the end surfaces, and wherein the coil is wound around the attachment members.

15. An image forming device comprising:

a transferring device transferring a developer onto a recording medium and forming a non-fixed image thereon; and a fixing device for fixing the non-fixed image on the recording medium with heat, the device including:

a heating member having a surface and rotatable about an axis;

a magnetic-flux generating unit including:

a coil disposed outside the heating member; and a current supplying unit supplying the coil with a current, thereby generating magnetic flux for heating the heating member through electromagnetic induction effect; and a pressing member in pressure contact with the heating member and pinching and conveying the recording medium in cooperation with the heating member in order to fix the developer on the recording medium, the pressing member including a first magnetic member that increases an amount of the magnetic flux that passes through the surface of the heating member, wherein the pressing member is formed with a hollow portion;

wherein the first magnetic member is disposed inside the hollow portion, the first magnetic member being provided as a separate member from the pressing member, the first magnetic member not rotating with the pressing member;

wherein the coil is disposed outside the pressing member, wherein a hollow space is defined inside the coil, and wherein the heating member is positioned in the hollow space of the coil; and wherein the coil is disposed at a position that is shifted, by a predetermined length, toward the first magnetic member from a position at which the axis of the heating member is positioned.

16. A fixing device for fixing a developer onto a recording medium, the device comprising:

a heating member having a surface and rotatable about an axis, the axis extending in an axial direction;

a magnetic-flux generating unit including:

a coil disposed outside the heating member; and a current supplying unit supplying the coil with a current, thereby generating magnetic flux for heating the heating member through electromagnetic induction effect; and a pressing member in pressure contact with the heating member and pinching and conveying the recording medium in cooperation with the heating member in order to fix the developer on the recording medium, the pressing member including a first magnetic member that increases an amount of the magnetic flux that passes through the surface of the heating member, wherein the first magnetic member is formed of an insulating material, wherein a hollow space is defined inside the coil, and wherein the heating member is positioned in the hollow space of the coil; and wherein the coil is disposed at a position that is shifted, by a predetermined length, toward the first magnetic member from a position at which the axis of the heating member is positioned.

17. The fixing device as claimed in claim 16, wherein the pressing member comprises a main body in pressure contact with the heating member; and wherein the main body is constituted by the first magnetic member formed of a magnetic material.

18. The fixing device as claimed in claim 16, wherein the pressing member has a peripheral surface in pressure contact with the heating member; and wherein the first magnetic member comprises a magnetic layer formed along the peripheral surface of the pressing member.

19. The fixing device as claimed in claim 16, wherein the pressing member includes:

at least two rollers rotatable about different rotational axes that are substantially parallel with each other; and a pressure belt looped around the at least two rollers and movable circularly around the at least two rollers.

20. The fixing device as claimed in claim 19, wherein each roller has a peripheral surface in contact with the pressure belt; and wherein the first magnetic member includes a magnetic layer formed along the peripheral surface of each roller.

21. The fixing device as claimed in claim 19, wherein the first magnetic member includes a magnetic layer formed along a substantially entire periphery of the pressure belt.

22. A fixing device for fixing a developer onto a recording medium, the device comprising:

a heating member having a surface and rotatable about an axis, the axis extending in an axial direction;

a magnetic-flux generating unit including:

a coil disposed outside the heating member; and a current supplying unit supplying the coil with a current, thereby generating magnetic flux for heating the heating member through electromagnetic induction effect; and a pressing member in pressure contact with the heating member and pinching and conveying the recording medium in cooperation with the heating member in order to fix the developer on the recording medium, the pressing member including a first magnetic member that increases an amount of the magnetic flux that passes through the surface of the heating member, wherein the pressing member is formed with a hollow portion;

wherein the first magnetic member is disposed inside the hollow portion, the first magnetic member being provided as a separate member from the pressing member, the first magnetic member not rotating with the pressing member;

wherein the coil is disposed outside the pressing member;

wherein a hollow space is defined inside the coil, and wherein the heating member is positioned in the hollow space of the coil;

wherein the heating member and the pressing member are aligned with each other in an alignment direction;

wherein the heating member is a substantially cylindrical member having a peripheral surface surrounding an axis and two end surfaces substantially perpendicular to the axis;

wherein the coil encloses the heating member in a cross section of the heating member and the coil, the cross section being perpendicular to the alignment direction;

the fixing device further comprising attachment members at positions where each attachment member confronts a corresponding one of the end surfaces; and wherein the coil is wound around the attachment members.

23. An image forming device comprising:

a transferring device transferring a developer onto a recording medium and forming a non-fixed image thereon; and a fixing device for fixing the non-fixed image on the recording medium with heat, the device including:

a heating member having a surface and rotatable about an axis;

a magnetic-flux generating unit including:

a coil disposed outside the heating member; and a current supplying unit supplying the coil with a current, thereby generating magnetic flux for heating the heating member through electromagnetic induction effect; and a pressing member in pressure contact with the heating member and pinching and conveying the recording medium in cooperation with the heating member in order to fix the developer on the recording medium, the pressing member including a first magnetic member that increases an amount of the magnetic flux that passes through the surface of the heating member, wherein the pressing member is formed with a hollow portion;

wherein the first magnetic member is disposed inside the hollow portion, the first magnetic member being provided as a separate member from the pressing member, the first magnetic member not rotating with the pressing member;

wherein the coil is disposed outside the pressing member;

wherein a hollow space is defined inside the coil, and wherein the heating member is positioned in the hollow space of the coil;

wherein the heating member and the pressing member are aligned with each other in an alignment direction;

wherein the heating member is a substantially cylindrical member having a peripheral surface surrounding an axis and two end surfaces substantially perpendicular to the axis;

wherein the coil encloses the heating member in a cross section of the heating member and the coil, the cross section being perpendicular to the alignment direction;

the fixing device further comprising attachment members at positions where each attachment member confronts a corresponding one of the end surfaces; and wherein the coil is wound around the attachment members.

24. A fixing device for fixing a developer onto a recording medium, the device comprising:

a heating member having a surface and rotatable about an axis, the axis extending in an axial direction;

a magnetic-flux generating unit including:

a coil disposed outside the heating member; and a current supplying unit supplying the coil with a current, thereby generating magnetic flux for heating the heating member through electromagnetic induction effect; and a pressing member in pressure contact with the heating member and pinching and conveying the recording medium in cooperation with the heating member in order to fix the developer on the recording medium, the pressing member including a first magnetic member that increases an amount of the magnetic flux that passes through the surface of the heating member, wherein the first magnetic member is formed of an insulating material;

wherein a hollow space is defined inside the coil, and wherein the heating member is positioned in the hollow space of the coil;

wherein the heating member and the pressing member are aligned with each other in an alignment direction;

wherein the heating member is a substantially cylindrical member having a peripheral surface surrounding an axis and two end surfaces substantially perpendicular to the axis;

wherein the coil encloses the heating member in a cross section of the heating member and the coil, the cross section being perpendicular to the alignment direction;

the fixing device further comprising attachment members at positions where each attachment member confronts a corresponding one of the end surfaces; and wherein the coil is wound around the attachment members.

* * * * *